US010555072B2

(12) United States Patent
Voishvillo

(10) Patent No.: US 10,555,072 B2
(45) Date of Patent: Feb. 4, 2020

(54) APERTURE PATTERNS AND ORIENTATIONS FOR OPTIMIZATION OF PHASING PLUG PERFORMANCE IN COMPRESSION DRIVERS

(71) Applicant: Harman International Industries, Incorporated, Stamford, CT (US)

(72) Inventor: Alexander Voishvillo, Simi Valley, CA (US)

(73) Assignee: Harman International Industries, Incorporated, Stamford, CT (US)

( * ) Notice: Subject to any disclaimer, the term of this patent is extended or adjusted under 35 U.S.C. 154(b) by 1008 days.

(21) Appl. No.: 14/308,457

(22) Filed: Jun. 18, 2014

(65) Prior Publication Data

US 2015/0373445 A1 Dec. 24, 2015

(51) Int. Cl.
*H04R 1/30* (2006.01)

(52) U.S. Cl.
CPC ..... *H04R 1/30* (2013.01); *H04R 2201/34* (2013.01)

(58) Field of Classification Search
CPC ..... H04R 1/02; H04R 1/30; H04R 2201/34
USPC ..... 381/150, 343
See application file for complete search history.

(56) References Cited

U.S. PATENT DOCUMENTS

| | | | | |
|---|---|---|---|---|
| 2,037,187 | A | 4/1936 | Wente | |
| 2,183,528 | A | 12/1939 | Blackburn | |
| 3,972,385 | A | 8/1976 | Hino et al. | |
| 4,050,541 | A | 9/1977 | Henricksen | |
| 6,064,745 | A * | 5/2000 | Avera | H04R 1/30 181/152 |
| 7,039,211 | B2 | 5/2006 | Werner | |
| 2008/0192972 | A1 | 8/2008 | Lewallen | |
| 2010/0329495 | A1 * | 12/2010 | Wendell | H04R 1/345 381/343 |
| 2011/0168480 | A1 * | 7/2011 | Sterling | H04R 1/345 181/176 |
| 2013/0182879 | A1 | 7/2013 | Graber et al. | |

FOREIGN PATENT DOCUMENTS

| | | | |
|---|---|---|---|
| CN | 104716258 | A | 6/2015 |
| WO | 2007122390 | A1 | 11/2007 |

OTHER PUBLICATIONS

Smith, B., "An Investigation of the Air Chamber of Horn Type Loudspeakers," Journal of the Acoustical Society of America, vol. 25, No. 2, Mar. 1953, 8 pages.
Henricksen, C., "Phase Plug Modelling and Analysis: Radial Versus Circumferential Types," Proceedings of the 59th AES Convention, Preprint No. 1328, Feb. 1978, 24 pages.
Kinsler, L et al., "Fundamentals of Acoustics," Fourth Edition, John Wiley & Sons, Inc., Dec. 1999, Chapter 7.4, 8 pages.
(Continued)

*Primary Examiner* — Sean H Nguyen
(74) *Attorney, Agent, or Firm* — McCoy Russell LLP

(57) ABSTRACT

Embodiments are disclosed that relate to phasing plugs for electroacoustic transducers. In some embodiments, a phasing plug comprises an inlet side, and outlet side, and a plurality of portions having an anfractuous perimeter and forming apertures therebetween, the plurality of portions and apertures arranged along a central axis and extending from the inlet side to the outlet side.

20 Claims, 27 Drawing Sheets

(56) References Cited

OTHER PUBLICATIONS

Dodd, M. et al., "A New Methodology for the Acoustic Design of Compression Driver Phase Plugs With Radial Channels," Proceedings of the 125th AES Convention, Preprint No. 7532, Oct. 2008, 16 pages.
Dodd, M. et al., "New Methodology for the Acoustic Design of Compression Driver Phase Plugs with Concentric Annular Channels," J. Audio Eng. Soc., vol. 57, No. 10, Oct. 2009, 17 pages.

* cited by examiner

APERTURE PATTERNS AND ORIENTATIONS FOR OPTIMIZATION OF PHASING PLUG PERFORMANCE IN COMPRESSION DRIVERS

FIELD

The disclosure relates to compression drivers and phasing plugs used therein.

BACKGROUND

In a transducer, energy of one form is converted to energy of a different form. Electroacoustic transducers particularly convert electrical signals to acoustic waves that may be perceived as audible sound to listeners. Some such electroacoustic transducers include horn drivers which produce sound pressure waves generated by a vibrating diaphragm—for example, a compression driver having an attached horn. Typically, the diaphragm of a compression driver is acoustically coupled to a horn via a phasing plug. The diaphragm and phasing plug are separated by a thin layer of air referred to as a compression chamber. The phasing plug performs several functions. The overall area of its acoustic entrance is significantly smaller than the area of a proximate diaphragm. This area gradually increases and matches the throat area of the waveguide or horn attached to the exit of the compression driver. The fact that the phasing plug entrance area is smaller than the area of the diaphragm increases loading impedance to provide matching of the output impedance of the vibrating diaphragm and the input impedance of the phasing plug followed by the horn or waveguide. Matched impedances provide maximum efficiency in the compression driver. Second, acoustic channels of the phasing plug provide equal path-lengths extending from different parts of the compression chamber to an exit of the phasing plug, the exit being coupled to an entrance (e.g., throat) of the horn. This prevents differences in phases of acoustic waves propagating through individual acoustic channels in the phasing plug and accordingly prevents occurrence of the combing effect that causes severe irregularity of high-frequency sound pressure response. The third function of the phasing plug is suppression of high-frequency standing waves that may occur in the compression driver.

In a horn driver, sound waves are directed to the horn through the acoustical channels of the phasing plug. The overall cross-sectional area of the channels gradually increases toward the exit of the phasing plug, finally matching the area of the horn's entrance (e.g., throat). Typically, a phasing plug configured for use in a compression driver having a dome diaphragm includes a set of concentric circular slots through which acoustic waves travel from the compression chamber to the horn entrance. The overall area of the slot entrances determines the acoustic input impedance of the phasing plug-horn combination. Maximum efficiency of the compression driver may be achieved when the output acoustic impedance of the vibrating diaphragm is equal to the loading acoustic impedance of the phasing plug-horn combination. The position and configuration of the slots in the phasing plug may help to suppress high-frequency air resonances in the compression chamber and correspondingly mitigate irregularity of frequency response at high frequencies where the radial dimension of the compression chamber is larger than the wavelength of the acoustic signal. In addition, the height (e.g., thickness) of the compression chamber separating the phasing plug and diaphragm influences the level of high-frequency signals, as the volume of air enclosed in the compression chamber is characterized by acoustic compliance that functions as a low-pass filter. As the volume of the compression chamber increases, so too does the attenuation of the high-frequency acoustical signal. The height of the compression driver is a compromise between the level of high-frequency signal and the risk of collision of the diaphragm and the phasing plug. Further, smaller compression chamber volumes (compared to the volumetric displacement of the diaphragm) are associated with higher nonlinear air compression distortion because the relationship between the variation of the compression chamber's volume and the level of the sound pressure in the compression chamber is intrinsically nonlinear.

SUMMARY

Embodiments are disclosed that relate to phasing plugs for electroacoustic transducers. In some embodiments, a phasing plug comprises an inlet side, and outlet side, and a plurality of portions having an anfractuous perimeter and forming apertures therebetween, the plurality of portions and apertures arranged along a central axis and extending from the inlet side to the outlet side.

In additional or alternative embodiments, an electroacoustic transducer comprises a waveguide, a driver having a diaphragm, and a phasing plug positioned intermediate the waveguide and the diaphragm. The phasing plug comprises an inlet side facing the diaphragm and having a surface contoured to the diaphragm, an outlet side facing the waveguide, and a plurality of portions having a flexuous perimeter and forming slots therebetween, the plurality of portions and slots arranged concentrically along a central axis and extending from the inlet side to the outlet side, the plurality of portions being substantially flush along a virtual plane perpendicular to the central axis at the outlet side.

In some embodiments, a horn driver comprises a horn, a driver having a diaphragm, and a phasing plug interposed between the horn and the diaphragm. The phasing plug comprises an inlet side facing the diaphragm and having a surface contoured to the diaphragm, an outlet side facing the waveguide, and a plurality of portions having a meandering perimeter and forming slots therebetween, the plurality of portions and slots arranged concentrically along a central axis and extending from the inlet side to the outlet side, the plurality of portions being substantially flush along a virtual plane perpendicular to the central axis at the outlet side, wherein the meandering perimeter is one of an approximately syncline pattern and an approximately sinusoidal pattern.

BRIEF DESCRIPTION OF THE DRAWINGS

The disclosure may be better understood from reading the following description of non-limiting embodiments, with reference to the attached drawings, wherein below.

DETAILED DESCRIPTION

As described above, electroacoustic transducers convert electrical signals to sound waves that may be perceived as audible sound to listeners. Compression drivers are one type of electroacoustic transducer, generating acoustic waves, by a vibrating diaphragm, that propagate through acoustic channels of a phasing plug toward a throat of a waveguide such as a horn. In particular, sound waves generated by a dome or annular diaphragm propagate radially in a compression chamber and enter the acoustic channels, generally propagating axially. As the overall area of entrances of the phasing plug is significantly smaller than the area of the diaphragm, sound energy transfer from the diaphragm to the horn may be maximized, in turn maximizing the amplitude of generated sound pressure waves. The acoustic channels or apertures of typical phasing plugs provide substantially equal paths along which acoustic waves may propagate to produce a coherent wavefront.

In such configurations, however, various issues may result in the compression chamber, the region of air between the diaphragm and an inlet side of the phasing plug. Here, high-frequency attenuation, nonlinear distortion due to excessive air compression, and resonance at frequencies where the radial dimension of the compression chamber is larger than the wavelength of acoustic waves may result, for example.

To mitigate these negative effects, phasing plugs having annular, hollow apertures may be utilized. The annular apertures may be positioned concentrically with respect to one another. In other approaches, phasing plugs having radial apertures may be used. In either case, wave cancellation and uneven frequency response may nevertheless result due in part to multiple high-frequency mechanical resonance in the diaphragm not accounted for by the placement and geometry of the apertures.

Accordingly, embodiments are disclosed that relate to phasing plugs configured to mitigate such negative effects. In some embodiments, a phasing plug comprises an inlet side, and outlet side, and a plurality of portions having an anfractuous perimeter and forming slots therebetween, the plurality of portions and slots arranged along a central axis and extending from the inlet side to the outlet side.

Figure 1:
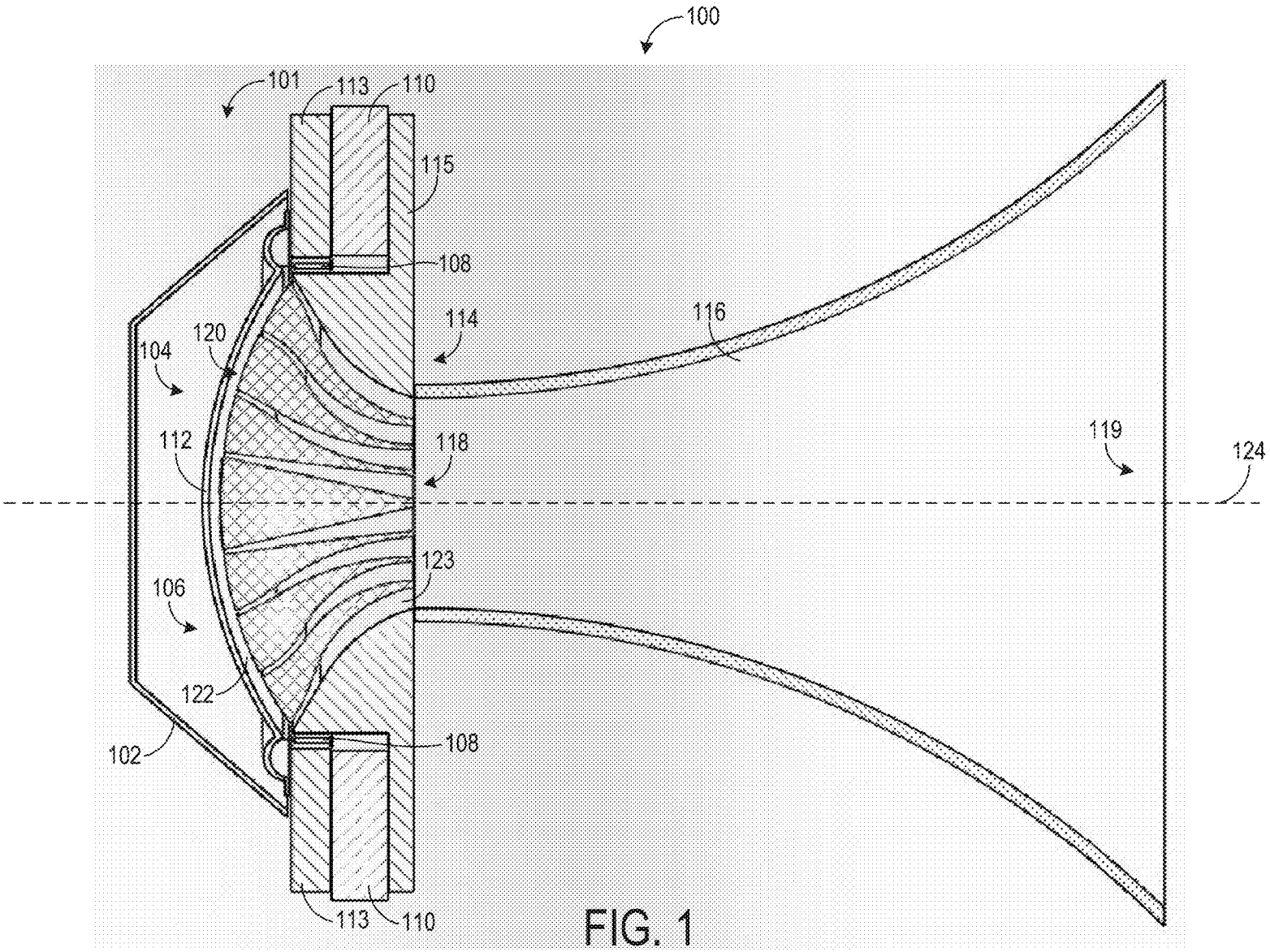
FIG. 1 is a sectional view of a horn driver in accordance with one or more embodiments of the present disclosure.

FIG. 1 is a sectional view of a horn driver 100 in accordance with one or more embodiments of the present disclosure. Horn driver 100 includes a compression driver 101, which is an electroacoustic transducer configured to generate sound pressure waves that may be perceived as audible sound by listeners. Horn driver 100 may be configured to reproduce various frequencies, including those in a low frequency range (e.g., 20-200 Hz), a medium frequency range (e.g., 200-5000 Hz), and/or a high-frequency range (e.g., 2-20 kHz), and may be employed in a variety of environments including stationary settings such as a room or mobile settings such as a vehicle. Reproduction of sound in the medium and/or high-frequency range may significantly increase the dimensions of a horn driver, however.

Horn driver 100 includes a rear enclosure 102 that at least partially encloses a driver 104 which may be operated to induce the generation of acoustic waves. In some embodiments, enclosure 102 may acoustically isolate a rear surface of a diaphragm described below at a rear side 106 of driver 104 and prevent modulation of the driver by other transducers (e.g., low-frequency woofers).

Enclosure 102 also provides a stable, fixed structure to which moving and non-moving components may be affixed, such as a voice coil 108 and a magnet 110. As shown, voice coil 108 may be positioned in a voice coil gap, which may be permeated with a magnetic field produced by magnet 110. Alternating current running through voice coil 108 may interact with the magnetic field in the voice coil gap, inducing motion in the voice coil proportional to the magnetic induction, magnitude of current in the voice coil, and length of the voice coil (e.g., the total length of a plurality of voice coil turns) immersed in the magnetic field in the voice coil gap. As voice coil 108 is coupled to a diaphragm 112, induced motion in the voice coil may be imparted to the diaphragm to generate acoustic waves. In the depicted example, magnet 110 may be statically positioned between a top plate 113 and a pole piece-back plate assembly 115, both positioned at a front side 114 of driver 104, though in other embodiments the magnet may be positioned in the voice coil gap. Voice coil 108, magnet 110, top plate 113, and/or pole piece-back plate assembly 115 may be collectively referred to as the motor of horn driver 100.

Various suitable materials may be used to form voice coil 108 and magnet 110. Voice coil 108 may be comprised of copper, aluminum, and/or other current-conducting materials including combinations thereof, such as copper-clad aluminum, for example. Magnet 110 may be a permanent magnet comprised of hard ferromagnetic materials, including but not limited to ferrites, Neodymium alloys, alnico, or alloys thereof. In other embodiments, magnet 110 may be omitted, with a permanent magnetic field produced by a field coil (e.g., a coil with constant current running therethrough). In this configuration, a compression driver may be provided without the inclusion of a motor.

It will be appreciated that the configuration of driver 104 shown in FIG. 1 is provided as an example and is not intended to be limiting in any way. For example, embodiments in which two or more voice coils are used and/or magnet 110 is a moving element affixed to diaphragm 112 with voice coil 108 positioned in the proximity of the moving magnet (e.g., in place of top plate 113) are also within the scope of the present disclosure. In addition, diaphragm 112 may assume other geometries than its concave form shown in FIG. 1, such as a convex geometry, and may include other features such as a dust cap or dome. Further, diaphragm 112 may utilize a flexural annular configuration in some embodiments.

In addition to including compression driver 101, horn driver 100 includes a waveguide 116, shown in this example as a horn having an expanding cross-sectional area that flares outwardly in at least one dimension, though other waveguide types are also contemplated. Waveguide 116 includes a throat aperture 118 proximate front side 114, and allows acoustic waves generated by diaphragm 112 at front side 114 to enter the throat, propagate through the waveguide, and exit the waveguide through a mouth 119.

Horn driver 100 further includes a phasing plug 120 that acoustically couples a compression chamber 122 formed between diaphragm 112 and the phasing plug to waveguide 116. Phasing plug 120 is configured to prevent destructive interference of acoustic waves generated by driver 104 by guiding such waves toward waveguide 116. Phasing plug 120 includes a plurality of apertures or slots (e.g., aperture 123) that provide substantially equal path lengths through which acoustic waves may travel, allowing a substantially coherent wavefront to reach throat aperture 118. As such, apertures 123 may also be referred to as acoustic channels. In this manner, sound may be produced with reduced cancellation and an extended, relatively flat frequency response at higher efficiencies and directionality relative to direct-radiating type loudspeakers.

As mentioned above, compression chamber 122 is a hollow, thin space interposed between diaphragm 112 and phasing plug 120. For embodiments in which diaphragm 112 is annular, compression chamber 122 may assume an annular shape as well. Phasing plug 120 is configured to mitigate several negative effects that may otherwise occur in compression chamber 122, such as variation in sound pressure in the compression chamber particularly along its radial dimension (e.g., perpendicular to central axis 124) for configurations in which diaphragm 112 includes a dome. As described above, high frequency attenuation may increasingly occur in compression chamber 122 as the height (e.g., thickness along central axis 124) of the compression chamber 122 increases. As such, the height of compression chamber 122 may be reduced to a practical extent; as a non-limiting example the radial dimension of the compression chamber may be 0.5 mm for a 100 mm diameter of diaphragm 112. As described below, the phasing plug embodiments provided herein address these and other issues, and may facilitate reduced non-linear distortion with flatter, extended frequency responses.

Thus, in the depicted configuration of FIG. 1, electrical signals applied to voice coil 108 may be transformed to mechanical vibrations of diaphragm 112 and thus generation of sound pressure waves. These sound pressure waves may then be directed to apertures 123 of phasing plug 120 via compression chamber 122, subsequently propagating to throat aperture 118 of waveguide 116. The sound pressure waves may then be perceived as audible sound by listeners.

FIGS. 2A-E show various views of a phasing plug 200 in accordance with one or more embodiments of the present disclosure. As seen in the top-front perspective view shown in FIG. 2A, phasing plug 200 includes a top 202 that is generally shaped to match the shape of a diaphragm proximate which it is to be placed; in this example the top is generally convex and approximately hemispherical, having a front surface 203 contoured to a generally concave diaphragm lacking a dome or dust cap such as diaphragm 112 of FIG. 1. The degree to which top 202 is convexly curved may be modified to match its proximate diaphragm, however. At an outer perimeter 207, top 202 includes a chamfer 204, which in other embodiments may be omitted.

Phasing plug 200 includes four solid portions 205 that are at least approximately concentrically aligned with one another with respect to a central axis 206 extending from an inlet side 208 to an outlet side 210 of the phasing plug and along its center. Collectively, portions 205 form front surface 203, extending therefrom and forming a bottom surface 212 described below. Proceeding outward from a radial axis 214 extending from central axis 206, portions 205 comprise an innermost portion 216, a second innermost portion 218, a second outermost portion 220, and an outermost portion 222, which collectively decrease in height with respect to central axis 206 in a smooth, gradual manner. With the exception of innermost portion 216, portions 205 are partially annular. In this example, portions 205 are approximately convex and symmetric for slices across the entire diameter of phasing plug 200 along radial axis 214 (or for any other radial axis perpendicular to and intersecting central axis 206). In some embodiments, portions 205 may span approximately equal geodesic lengths of front surface 203—e.g., as measured along a geodesic 224. Alternatively, portions 205 may span approximately equal radial lengths as measured along radial axis 214. Portions 216, 218, 220, and 222 may be held in place by one or more structures (not shown)—e.g., mechanical bridges extending at least partially radially across the portions.

As shown, adjacent pairs of portions 205 are separated by apertures or slots 226 that provide hollow portions through which acoustic waves may travel and further form front surface 203. Like portions 205, apertures 226 span the vertical length of phasing plug 200 (e.g., as measured along central axis 206) from front surface 203 and inlet side 208 to bottom surface 212 and outlet side 210. In the depicted embodiment, apertures 226 comprise three apertures that may be evenly distributed across front surface 203 (e.g., as measured along a geodesic extending from central axis 206 to outer perimeter 207 of top 202), though their spatial distribution may be asymmetric in other embodiments. The numbers of portions and apertures shown are provided as non-limiting examples, however, and are not intended to be limiting in any way.

Each aperture 226 exhibits a generally meandering, flexuous, and/or anfractuous pattern that regularly repeats circumferentially along front surface 203. The pattern generally varies in an approximately sawtooth and/or syncline pattern, imbuing phasing plug 200 with what is referred to herein as a "snowflake" aperture pattern. In this example, the patterns include eight peaks (e.g., peak 228) and eight troughs (e.g., trough 230) separated by intervening segments (e.g., segment 232) that are slightly curved, though in other embodiments these segments may be straight and linear. As such, the snowflake pattern may differ from a typical sawtooth pattern by a percentage of curvature, for example—e.g., 10-20%. In other embodiments, however, the snowflake pattern may be an exactly sawtooth (or syncline) pattern, in which case straight segments may separate peaks 228 and troughs 230.

Other numbers of peaks 228 and/or troughs 230 are possible without departing from the scope of this disclosure, and, in some embodiments, the number of peaks and/or troughs may differ for different apertures 226. Due to their intervening placement, apertures 226 define generally meandering, flexuous, and/or anfractuous perimeters for each of portions 205; with the exception of outermost portion 222 which has a circular outer perimeter and innermost portion 216 which lacks an inner perimeter, the remaining portions have inner and outer perimeters that exhibit such a pattern. In some embodiments, the geodesic length of each aperture 226 may be constant as top 202 is traversed circumferentially, though in other embodiments this length may be unequal—for example, a greater geodesic length may exist between adjacent peaks 228 than at adjacent troughs 230. Such geodesic lengths may further vary for given apertures 226.

In this embodiment, apertures 226 and their patterns are symmetric for slices across the entire diameter of phasing plug 200 along radial axis 214 such that each portion 205 exhibits the same general meandering inner and/or outer perimeter, though the perimeter patterns scale down as top 202 is traversed radially inward toward innermost portion 216 (e.g., the lengths of segments 232 decrease for an aperture 226 that is closer to central axis 206 than for an aperture that is farther away from the central axis). Further, apertures 226 and the inner and/or outer perimeter patterns of portions 205 may be geodesically aligned—for example, peaks 228 of adjacent (two or more) apertures intersect along geodesic 224.

Figure 2A:
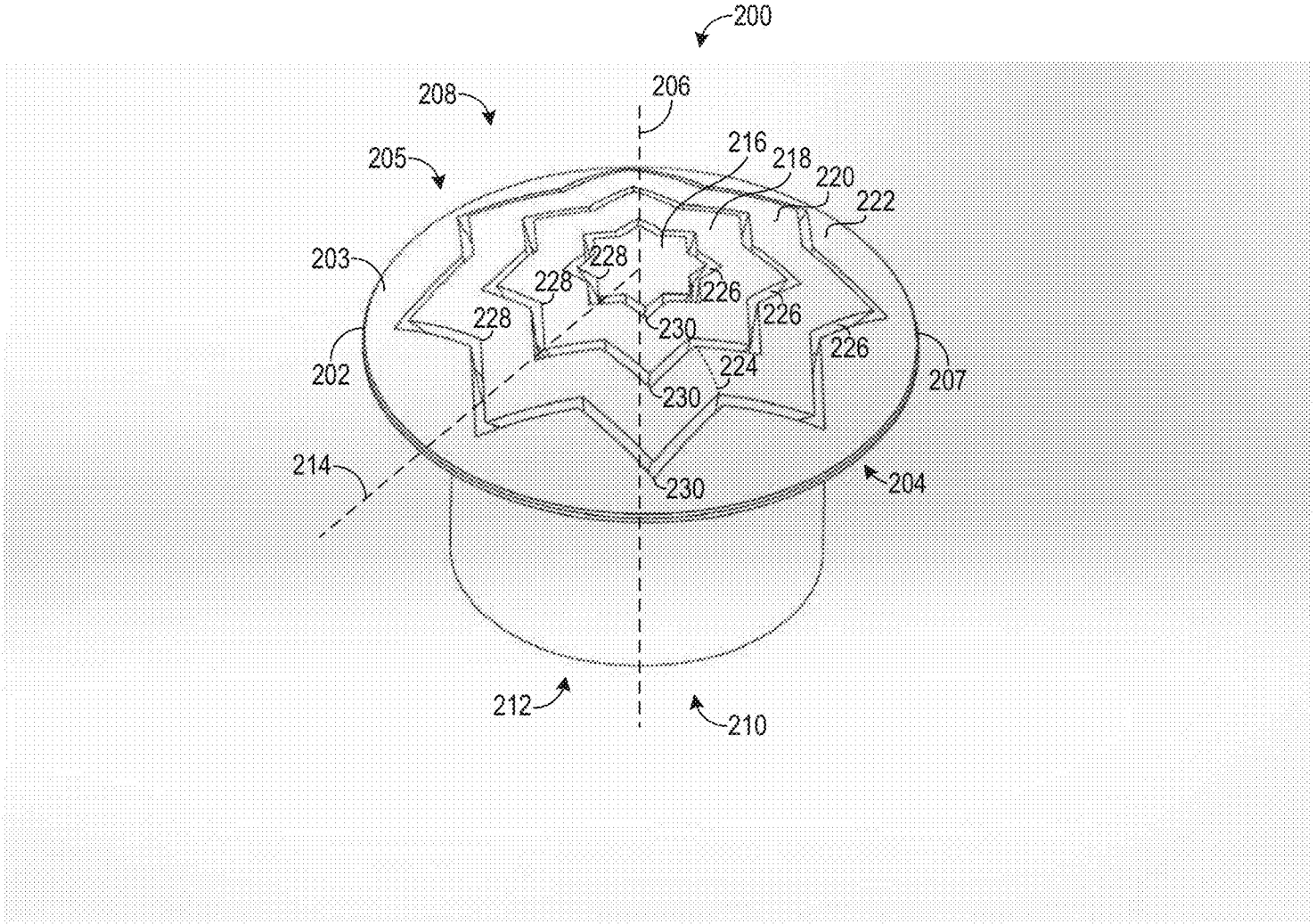
FIGS. 2A-E show various views of a phasing plug in accordance with one or more embodiments of the present disclosure.
Figure 2B:
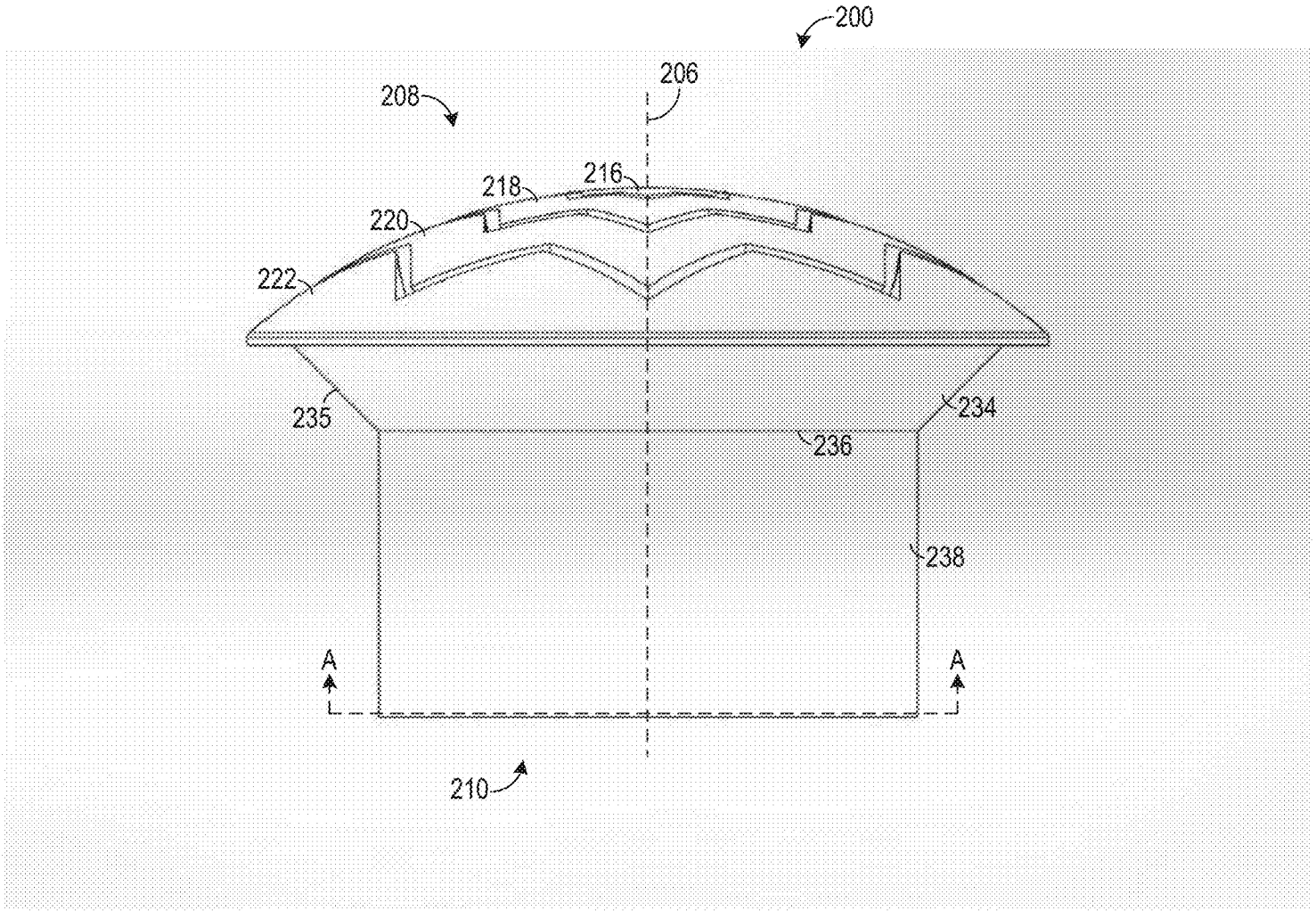

FIG. 2B shows a side view of phasing plug 200. As shown, top 202 is coupled at its bottom side to a midsection 234 having an outer perimeter 235 defined by outermost portion 222, decreasing in a linear, conical fashion as central axis 206 is traversed downwardly such that its diameter assumes a larger value at a first height along the central axis than that at a second, lower height along the central axis. The uppermost portion of midsection 234 is joined to the bottom side of top 202 at a distance radially inward from the outer perimeter of the top such that the top partially overhangs the midsection. From the perspective of FIG. 2B, this configuration generally imbues phasing plug 200 with what is referred to herein as a "mushroom" shape. Midsection 234 may assume non-conical geometries without departing from the scope of this disclosure, however.

At a midsection boundary 236, midsection 234 couples to a cylindrical bottom 238 whose cross-sectional area is approximately constant along central axis 206, with respect to slicing planes perpendicular to the central axis. Collectively, top 202, midsection 234, and bottom 238 each house respective subsets of portions 205. More particularly, as outermost portion 222 extends from front surface 203 to bottom surface 212, the outermost portion may be considered to define the overall outer perimeter and surface of phasing plug 200, as well as what be referred to as a "frame", the frame comprising the portion of the phasing plug extending from its outer surface radially inward to the most radially outward aperture 226—e.g., the solid portion of the phasing plug that is outwardly bounded by this aperture. It will be appreciated that the height of bottom 238, measured along central axis 206, may be varied without departing from the scope of this disclosure. In other embodiments, bottom 238 may be omitted, in which case phasing plug 200 and apertures 226 may terminate at midsection boundary 236 of midsection 234.

Figure 2C:
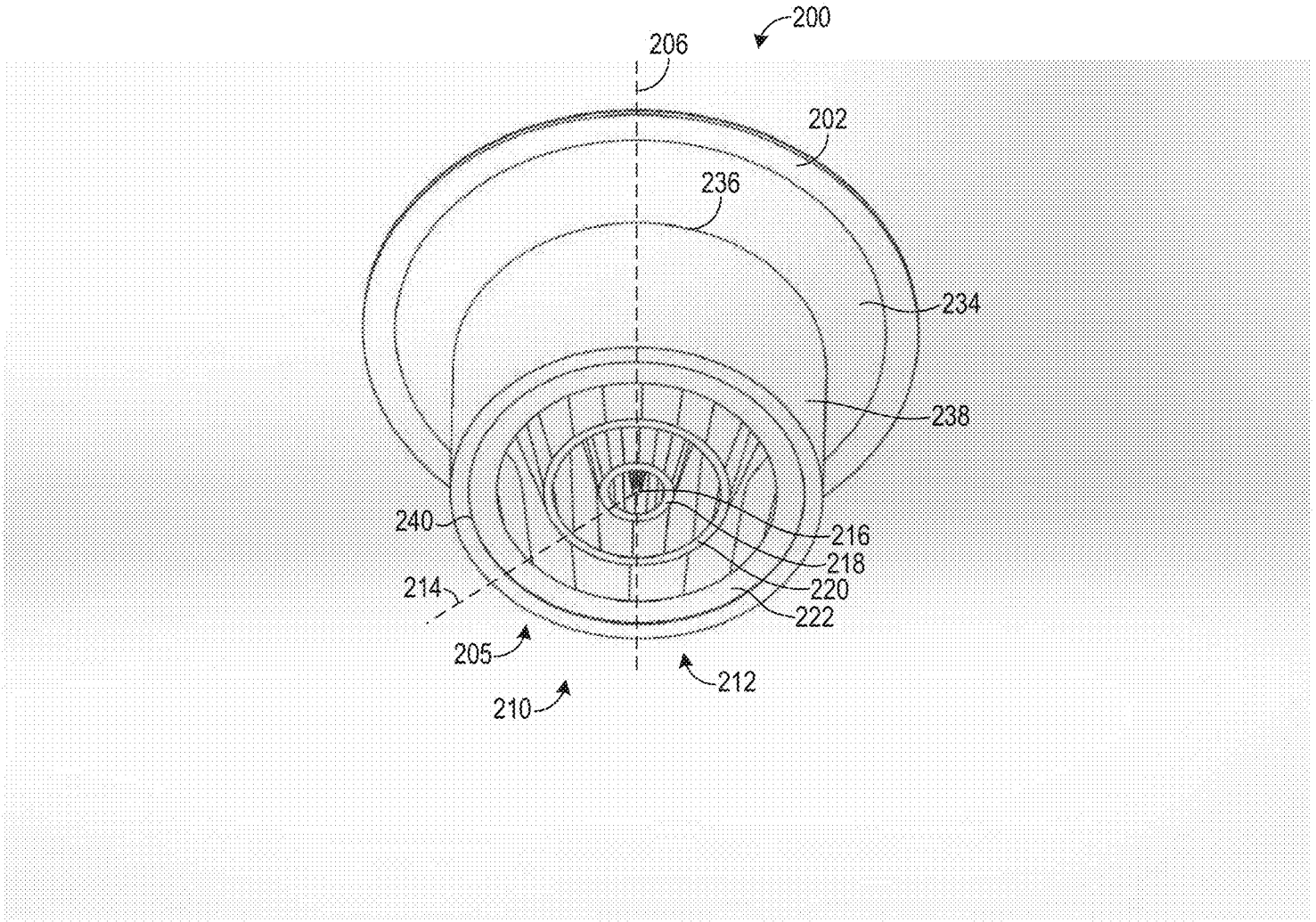

Turning now to FIG. 2C, a bottom-front perspective view of phasing plug 200 is shown. Here, portions 205 define bottom surface 212 which includes solid annular portions (with the exception of innermost portion 216 having a circular bottom surface) separated by hollow annular apertures 226. As with front surface 203, portions 205 may be equally spaced from one another with respect to radial axis 214. Moreover, in some embodiments, the bottom surfaces of each portion 205 may be substantially flush (e.g., within 10 mm) along a plane perpendicular to central axis 206. As shown, the radial lengths of second innermost portion 218 and second outermost portion 220 may be approximately equal, with the radial length of outermost portion 222 being relatively larger. In some configurations, the bottom surface of outermost portion 222 may include a boundary line 240 defining a difference in the heights of the surfaces on either of its sides, though such heights may be equal in other configurations.

Figure 2D:
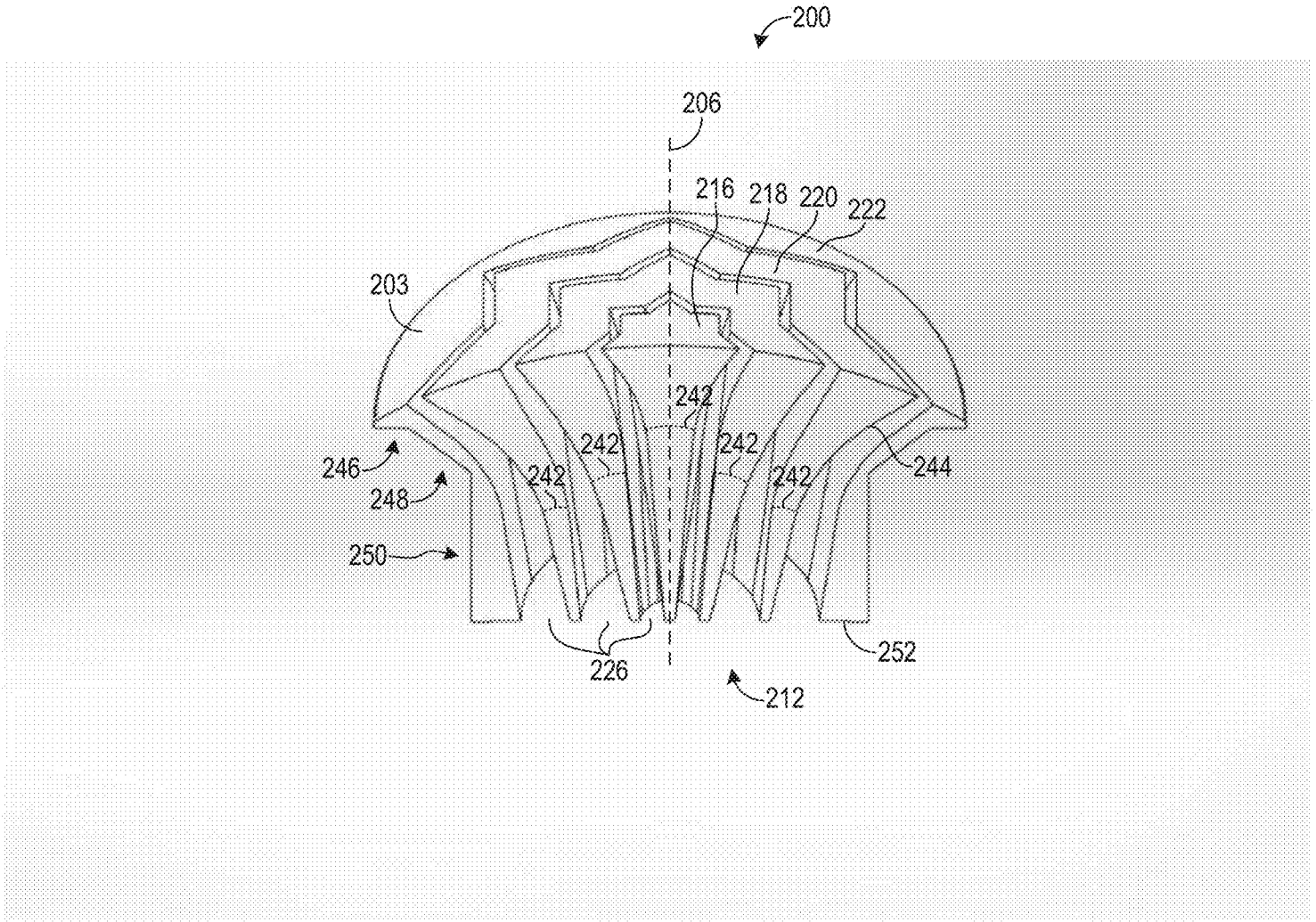

FIG. 2D shows a top-front perspective view of a cross-section of phasing plug 200 taken along line A-A in FIG. 2B. The variation in the cross-sectional area of portions 205 along central axis 206 is particularly illustrated. As shown, the cross-sectional area of innermost portion 216, second innermost portion 218, and second outermost portion 220 at least partially differs between a region proximate front surface 203 and a lower region proximate bottom surface 212. Arcs 242 generally approximate the respective boundaries between these regions for each portion 205, though it will be understood that the changes in cross-sectional area are gradual.

Above arc 242, the outer edges of innermost portion 216 taper inward toward central axis 206 as it is traversed downwardly in an approximately parabolic or hyperbolic manner. In this region, the decrease in cross-sectional area of innermost portion 215 is more pronounced than that in the region below arc 242, where the outer edges of the innermost portion taper inward in an approximately linear and conical fashion. A similar variation in cross-sectional area applies to portions 218 and 220, though, above their respective arcs 242, their outer edges that are further radially outward (e.g., edge 244) display greater curvature than their further radially inward counterpart.

Conversely, the variation in cross-sectional area taken along line A-A in FIG. 2B differs for outermost portion 222, displaying roughly three general areas of variation. At an uppermost region 246 proximate front surface 203, the cross-sectional area is approximately triangular, varying more along radial axis 214. At a relatively lower middle region 248, the cross-sectional area displays a relatively slight and conical decrease. Finally, at a relatively still lower bottom region 250, the cross-sectional area displays an approximately triangular decrease until truncating at an edge 252 forming bottom surface 212. As described above, this truncation may imbue phasing plug 200 with a substantially flat bottom surface 212, though non-flat surfaces are also contemplated. In such an embodiment, a virtual plane including the nadirs of the bottom surfaces of each portion 205 may be formed along bottom surface 212.

Figure 2E:
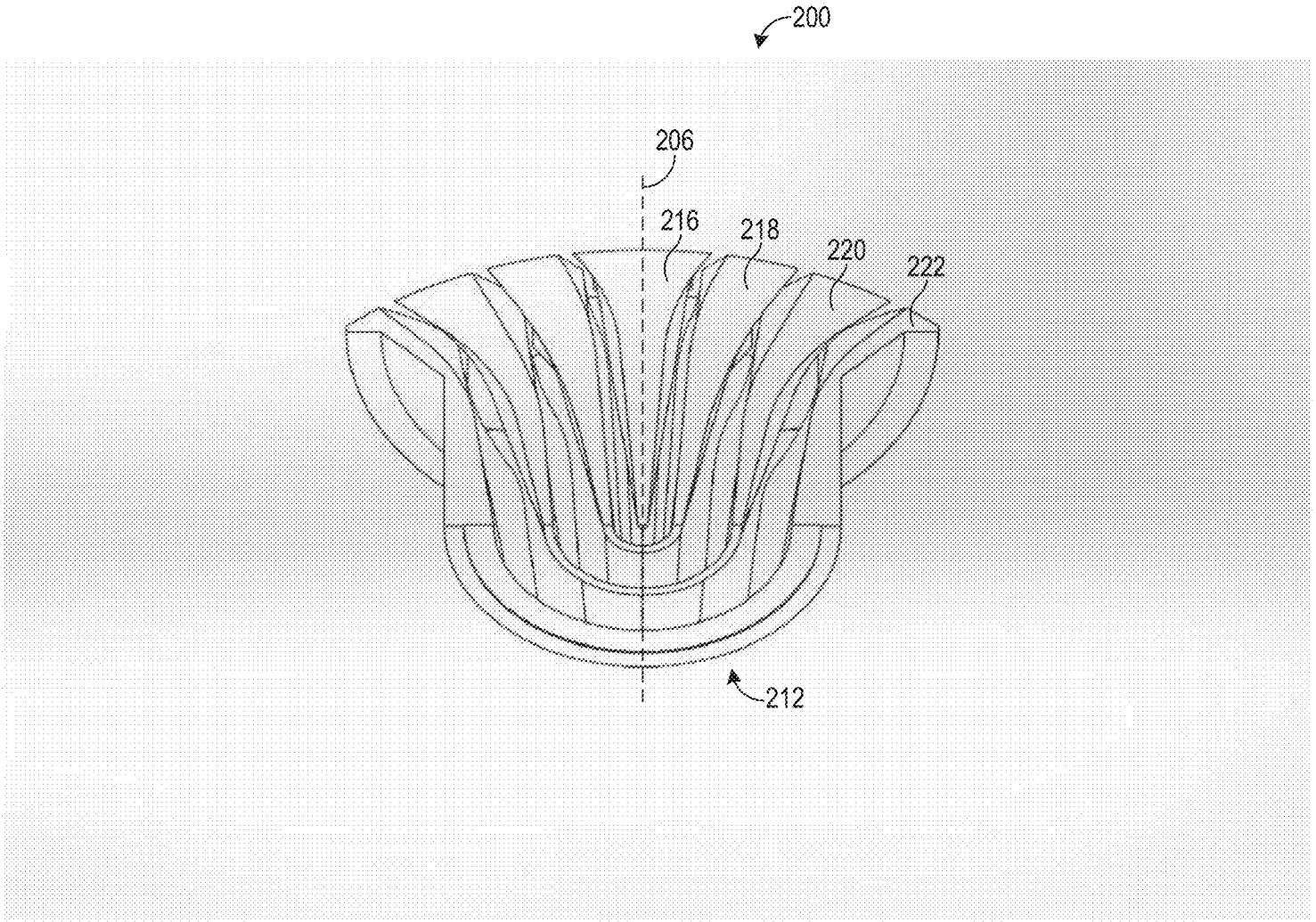

As apertures 226 are three-dimensional complements defined by adjacent edges of adjacent portions 205, their cross-sectional variation along central axis 206 may be substantially understood from the description above. Generally, the cross-sectional areas of apertures 226 increase as central axis 206 is traversed downwardly, and this increase varies roughly between an approximately curved variation (e.g., parabolic, hyperbolic, etc.) and an approximately linear, conical variation. In this configuration, apertures 226 provide increasing volume in which acoustic waves may propagate as central axis 206 is traversed downwardly. In some embodiments, the path-lengths of apertures 226 (a path-length for a given aperture being the distance along which acoustic waves travel in that aperture, for example) may be substantially equal (e.g., within several millimeters). Along edge 252, the radial distance separating outermost portion 222 from second outermost portion 220 may be substantially equal (e.g., within 5 mm) to the radial distance separating the second outermost portion from the second innermost portion 218. The radial distance along edge 252 separating second innermost portion 218 from innermost portion 216, however, may be relatively smaller and in some embodiments approximately half as much as the aforementioned radial distances. FIG. 2E shows a bottom-front perspective view of the cross-section of phasing plug 200 taken along line A-A in FIG. 2B, and further illustrates the aspects mentioned above.

Figure 3A:
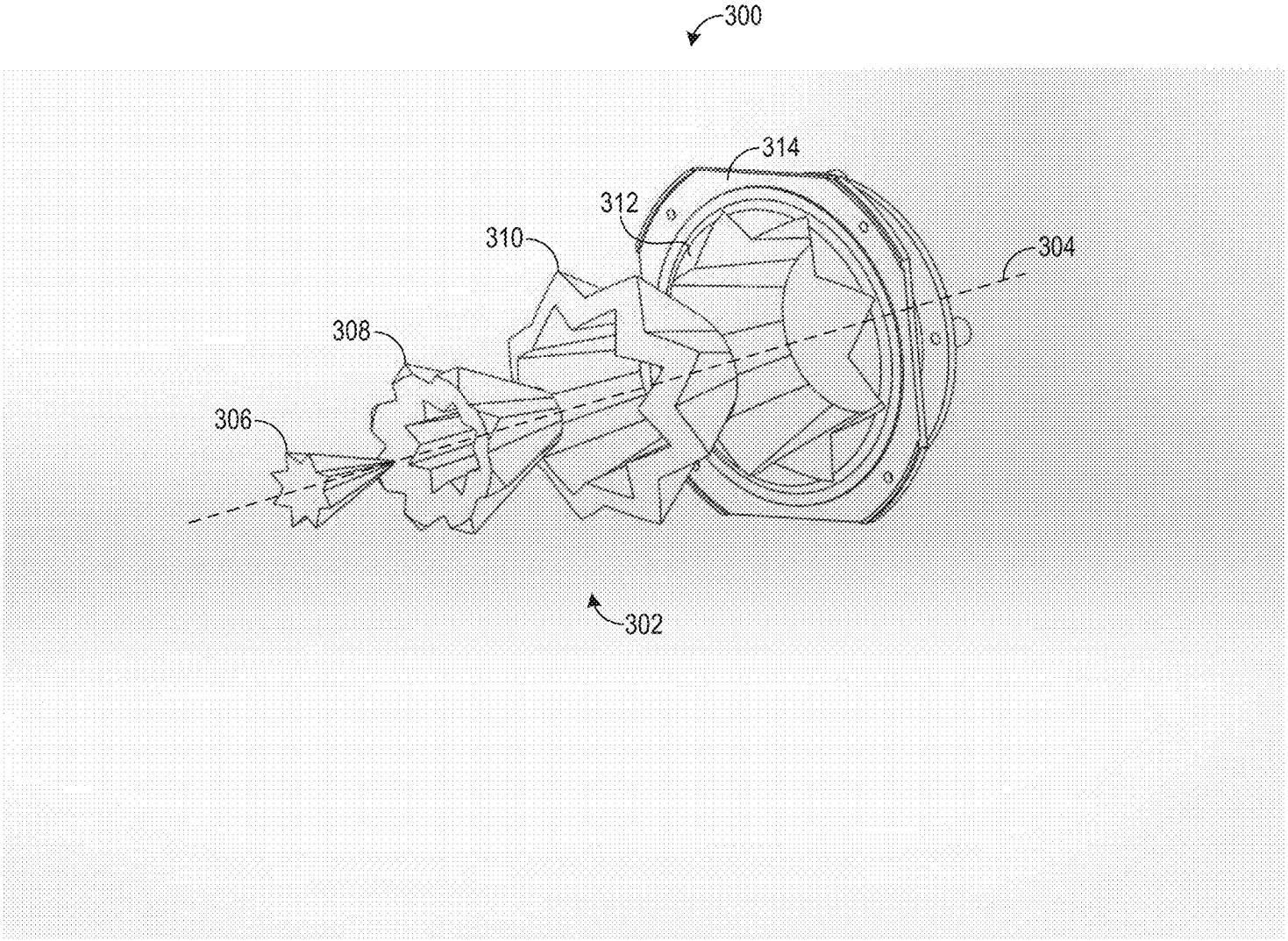
FIGS. 3A-G show various views of another phasing plug in accordance with one or more embodiments of the present disclosure.

FIGS. 3A-G show various views of a phasing plug 300 in accordance with one or more embodiments of the present disclosure. FIG. 3A particularly shows an exploded view of phasing plug 300, illustrating four solid portions 302 that comprise the phasing plug and that are at least approximately concentrically aligned with one another along a central axis 304. Proceeding from left to right in FIG. 3A, and radially outward when positioned in a non-exploded configuration, portions 302 include an innermost portion 306, a second innermost portion 308, a second outermost portion 310, and an outermost portion 312. As described in further detail below, outermost portion 312 is shown as including a frame 314 that may facilitate secure mounting in a suitable environment (e.g., interposed between a diaphragm and waveguide) and may be considered a component separate from the outermost portion and phasing plug itself. Portions 302 may be held in place by one or more structures (not shown)—e.g., mechanical bridges extending at least partially radially across the portions.

Figure 3B:
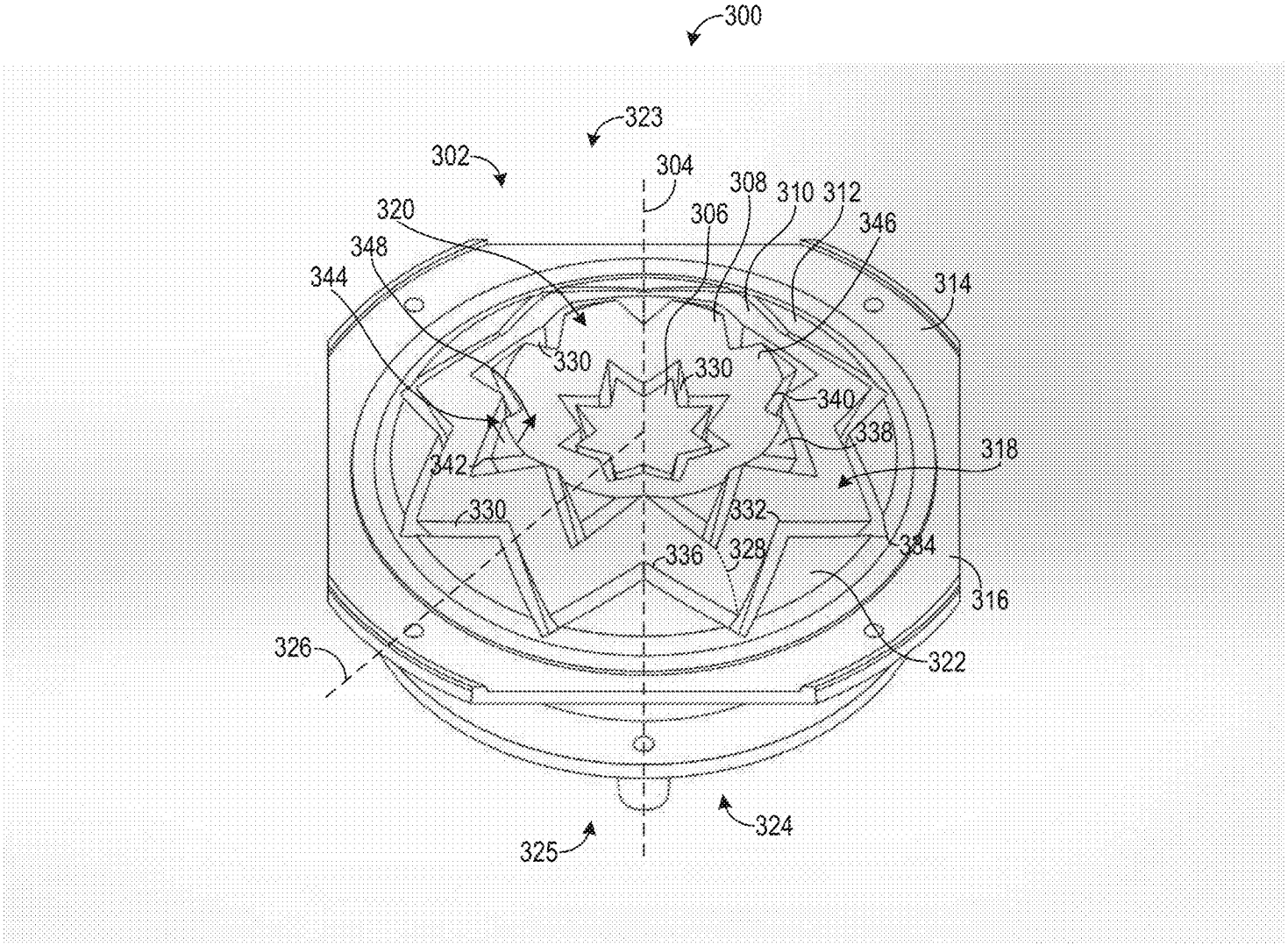

Turning now to FIG. 3B, a top-front perspective view of phasing plug 300 is shown. As shown, phasing plug 300 includes a top 316 that is generally shaped to match the shape of a diaphragm proximate which it is to be placed; in this example the top is generally convex in a first annular region 318 and generally concave in a second annular region 320 that extends from central axis 304, the second annular region being further radially inward than the first annular region. Such a configuration is adapted to a concave diaphragm having a convex and generally spherical or parabolic dome or dust cap. The area spanned by first and second annular regions 318 and 320, as well as the degree to which these regions are respectively convex and concave, may be varied to suit various diaphragms (e.g., in order to adapt to varying dome or dust cap sizes). Moreover, in other embodiments, first annular region 318 may be generally concave and second annular region 320 may be generally convex. Generally, first annular region 318 may have a different curvature than that of second annular region 320.

Portions 302 collectively form a front surface 322, extending therefrom at an inlet side 323 and forming a bottom surface 324 described below at an outlet side 325. With the exception of innermost portion 306, portions 305 are partially annular. Moreover, portions 305 are symmetric for slices across the entire diameter of phasing plug 300 along radial axis 326 (or for any other radial axis perpendicular to and intersecting central axis 304). In some embodiments, portions 302 may span approximately equal geodesic lengths of front surface 322—e.g., as measured along a geodesic 328.

As shown, adjacent pairs of portions 302 are separated by apertures or slots 330. Like portions 302, apertures 330 span the vertical length of phasing plug 300 (e.g., as measured along central axis 304) from front surface 322 and inlet side 323 to bottom surface 324 and outlet side 325. In the depicted embodiment, apertures 330 comprise three apertures that may be evenly distributed across front surface 322 (e.g., as measured along a geodesic extending from central axis 304 to the outer perimeter of top 316), though their spatial distribution may be asymmetric in other embodiments. The numbers of portions and apertures shown are provided as non-limiting examples, however, and are not intended to be limiting in any way.

As with apertures 226 in FIG. 2A, each aperture 330 exhibits a generally meandering, flexuous, and/or anfractuous pattern that regularly repeats circumferentially along front surface 203. The pattern generally varies in an approximately sawtooth and/or syncline pattern, imbuing phasing plug 300 with the snowflake aperture pattern. In this example, the patterns include eight peaks (e.g., peak 332) and eight troughs (e.g., trough 334) separated by intervening segments (e.g., segment 336) that are slightly curved. As such, the snowflake pattern may differ from a typical sawtooth pattern by a percentage of curvature, for example—e.g., 10-20%. In other embodiments, however, the snowflake pattern may be an exactly sawtooth (or syncline) pattern, in which case straight segments may separate peaks 228 and troughs 230.

Other numbers of peaks 332 and troughs 334 are possible without departing from the scope of this disclosure, and, in some embodiments, the number of peaks 332 and/or troughs 334 may differ for different apertures 330. Due to their intervening placement, apertures 330 define generally meandering, flexuous, and/or anfractuous perimeters for each of portions 302; with the exception of outermost portion 312 which has a circular outer perimeter encompassed by frame 314 (which has a partially circular perimeter interrupted by straight beveled segments) and innermost portion 306 which lacks an inner perimeter, the remaining portions have inner and outer perimeters that exhibit such a pattern. In some embodiments, the geodesic length of each aperture 330 may be constant as top 316 is traversed circumferentially, though in other embodiments this length may be unequal—for example, a greater geodesic length may exist between adjacent peaks 332 than at adjacent troughs 334. Such geodesic lengths may further vary for given apertures 330.

In this embodiment, apertures 330 and their patterns are symmetric for slices across the entire diameter of phasing plug 300 along radial axis 326 such that each portion 302 exhibits the same general meandering inner and/or outer perimeter, though the perimeter patterns scale down as top 316 is traversed radially inward toward innermost portion 306 (e.g., the lengths of segments 336 decrease for an aperture 330 that is closer to central axis 304 than for an aperture that is farther away from the central axis). Further, apertures 330 and the inner and/or outer perimeter patterns of portions 302 may be geodesically aligned—for example, peaks 332 of adjacent (two or more) apertures intersect along geodesic 328.

FIG. 3B also illustrates variation in the surface of second innermost portion 308. Specifically, second innermost portion 308 includes a first surface region falling within first annular region 318 that comprises eight convex triangular sections (e.g., triangular section 338) regularly spaced around a meandering boundary 340 with portions of the meandering boundary interposed between adjacent pairs of the portions. Tips (e.g., tip 342) of triangular sections 338 define the regions of second innermost portion 308 that are most radially outward from central axis 304. Triangular sections 338 may be defined by respective first surface normals such as first surface normal 344 having an angle of +30° relative to central axis 304, for example. Conversely, meandering boundary 340 also defines, within its interior, a second surface region falling within second annular region 320 that comprises a partially annular section 346 whose inner perimeter is defined by the inner perimeter of second innermost portion 308. As partially annular section 346 exhibits varying curvature along radial axis 326, it may be defined by a plurality of surface normals having various angles relative to central axis 304. In some embodiments, at a region immediately proximate a triangular section 338, partially annular section 346 may be defined by a second surface normal 348 having an angle that is the additive inverse of the angle of first surface normal 344 (e.g., −30°), for example. Meandering boundary 340 thus separates two regions of different curvature.

Figure 3C:
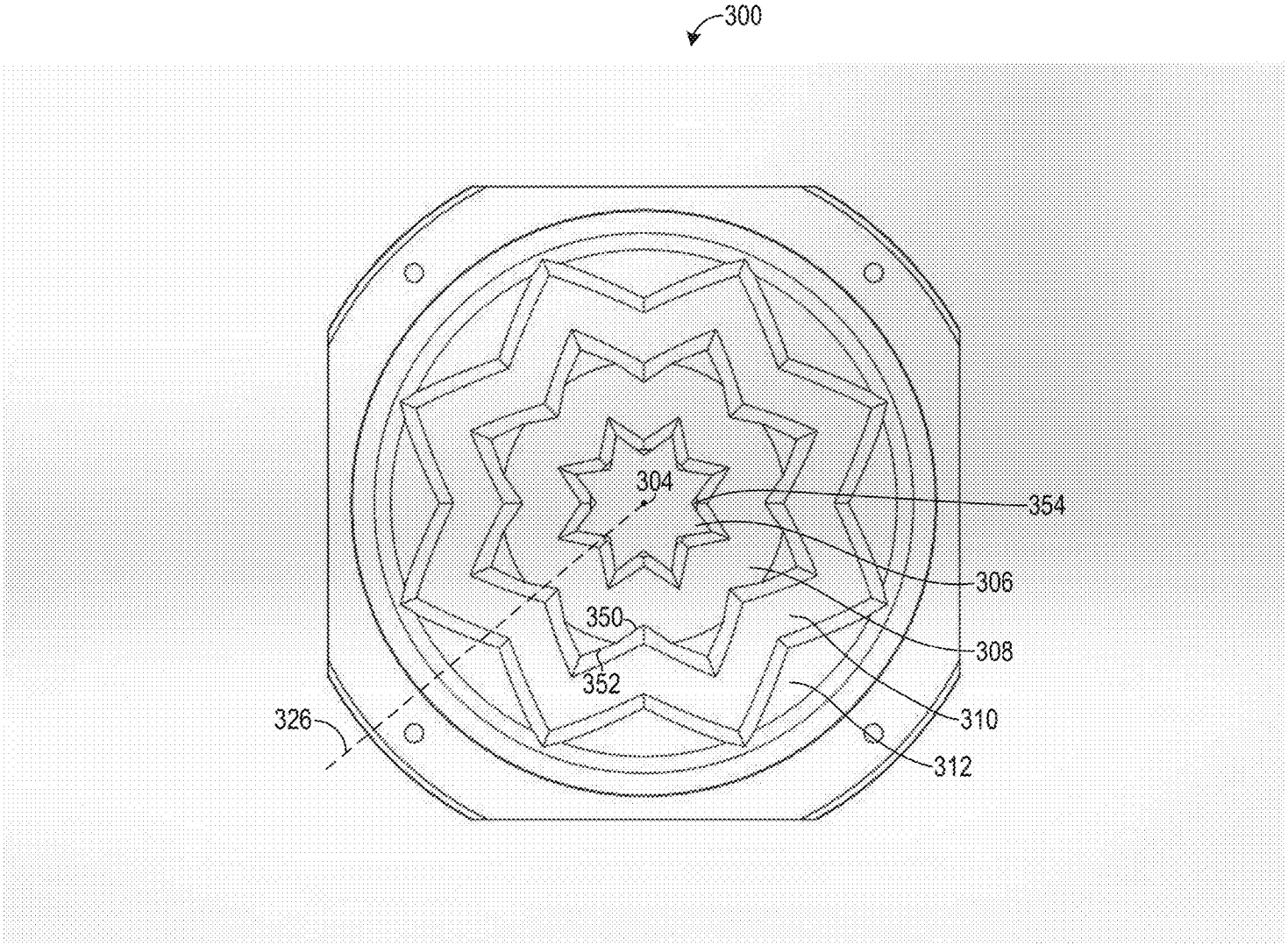

FIG. 3C shows a top view of phasing plug 300, illustrating some of the aforementioned aspects (e.g., radial symmetry, distribution of portions 302 and apertures 330 along front surface 322) in addition to others. As seen in this top view, portions 302 may occupy approximately the same radial lengths as measured along radial axis 326. Alternatively, portions 302 may occupy approximately the same geodesic lengths as measured along geodesic 328.

FIG. 3C also illustrates how the inner and/or outer perimeters of one or more portions 302 may vary. In the depicted embodiment, each segment 336 of second innermost portion 308 that forms its outer perimeter includes a first subsegment 350 and a second subsegment 352 whose curvatures differ slightly from each other. In other embodiments, such variation in curvature may be omitted, imbuing each segment with constant curvature throughout.

Finally, FIG. 3C illustrates how a portion of apertures 330 may be visible from inlet side 323 to outlet side 325 throughout the entire vertical length of phasing plug 300 as seen from the top view. From this perspective, eight openings (e.g., opening 354) assuming a triangular shape may be apparent. Openings 354 may also appear triangular as seen from a bottom perspective as described below.

Figure 3D:
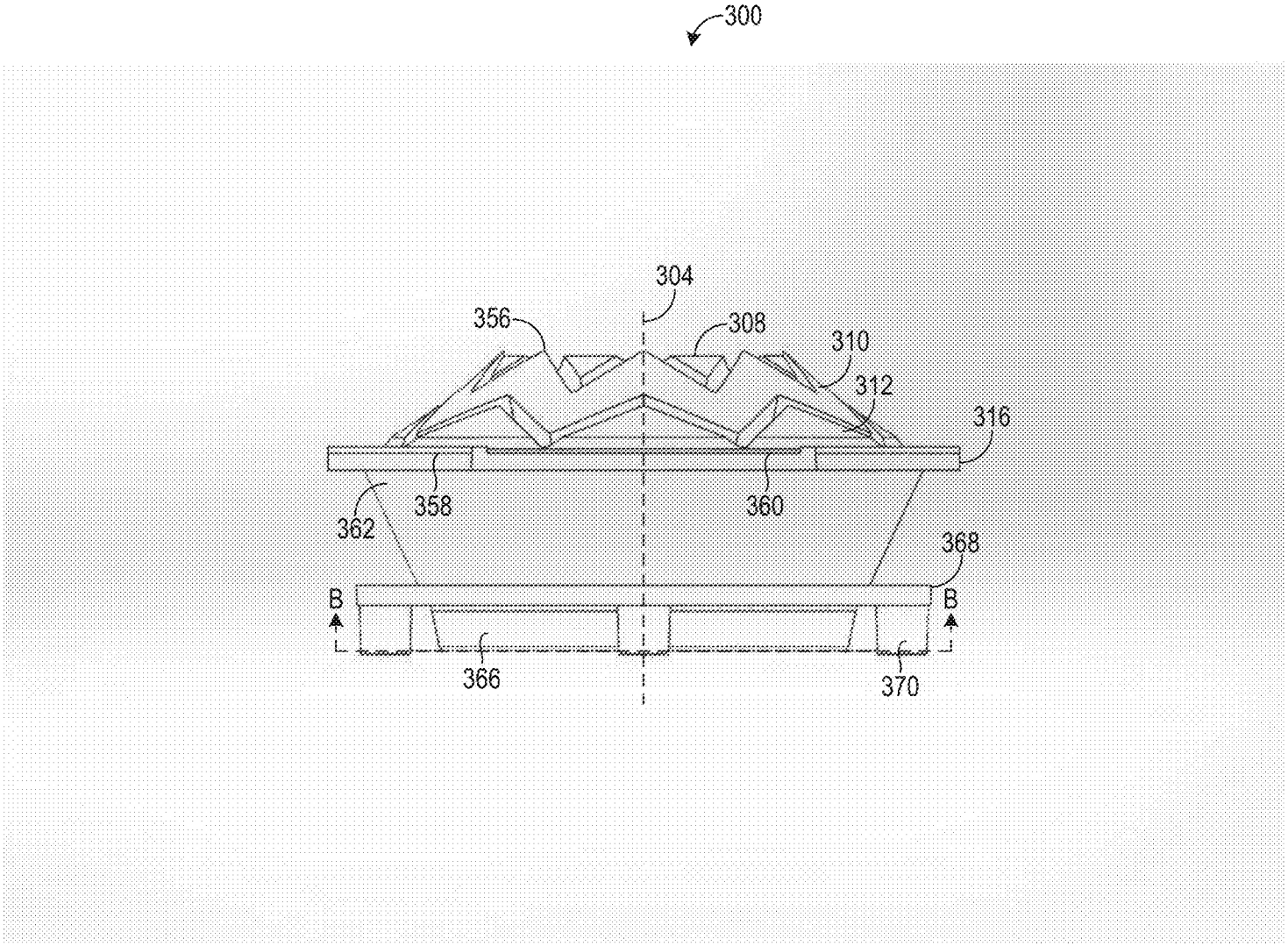

Turning now to FIG. 3D, a side view of phasing plug 300 is shown. As seen in this view, second outermost portion 310 reaches the highest point of phasing plug 300 at an apex 356 along central axis 304. Apex 356 may exceed that of second innermost portion 308 (e.g., by 10 mm), though in other embodiments the two may be flush, forming a virtual plane that includes the apexes of both the second outermost portion 310 and the second innermost portion. In the case that such a virtual plane is formed, the apexes of second outermost portion 310 would be separated from the apexes of second innermost portion 310 along a horizontal axis (not shown) extending across the diameter of phasing plug 300 and perpendicular to central axis 304.

Top 316 includes a first chamfer 358 along the circular portion of its outer perimeter and a second chamfer 360 along the straight beveled portion of its outer perimeter that is horizontally separated from the first ridge. The beveled portion reaches a slightly lower height along central axis 304 than that of the circular portion. At its bottom side, top 316 is coupled to a midsection 362 whose outer perimeter may at least partially defined by outermost portion 312, decreasing in a linear, conical fashion as central axis 304 is traversed downwardly such that its diameter assumes a larger value at a first height along the central axis than that at a second, lower height along the central axis. The uppermost portion of midsection 362 is joined to the bottom side of top 316 at a distance radially inward from the outer perimeter of the top such that the top partially overhangs the midsection. Midsection 362 may assume non-conical geometries without departing from the scope of this disclosure, however.

At a midsection boundary, midsection 362 couples to a bottom 366 whose cross-sectional area decreases along central axis 304 at a rate less than that of the midsection with respect to slicing planes perpendicular to the central axis. It will be appreciated that the height of bottom 366, measured along central axis 304, may be varied without departing from the scope of this disclosure. In other embodiments, bottom 366 may be omitted, in which case phasing plug 300 and apertures 330 may terminate at the midsection boundary. A mount 368, which may be separately or integrally formed with bottom 366, surrounds the bottom in an approximately concentric manner. Mount 368 is partially annular and, in this example, includes four projections (e.g., projection 370) each having cylindrical bores through which various types of fasteners (e.g., screws) may be inserted to securely affix phasing plug 300 in a surrounding environment.

Figure 3E:
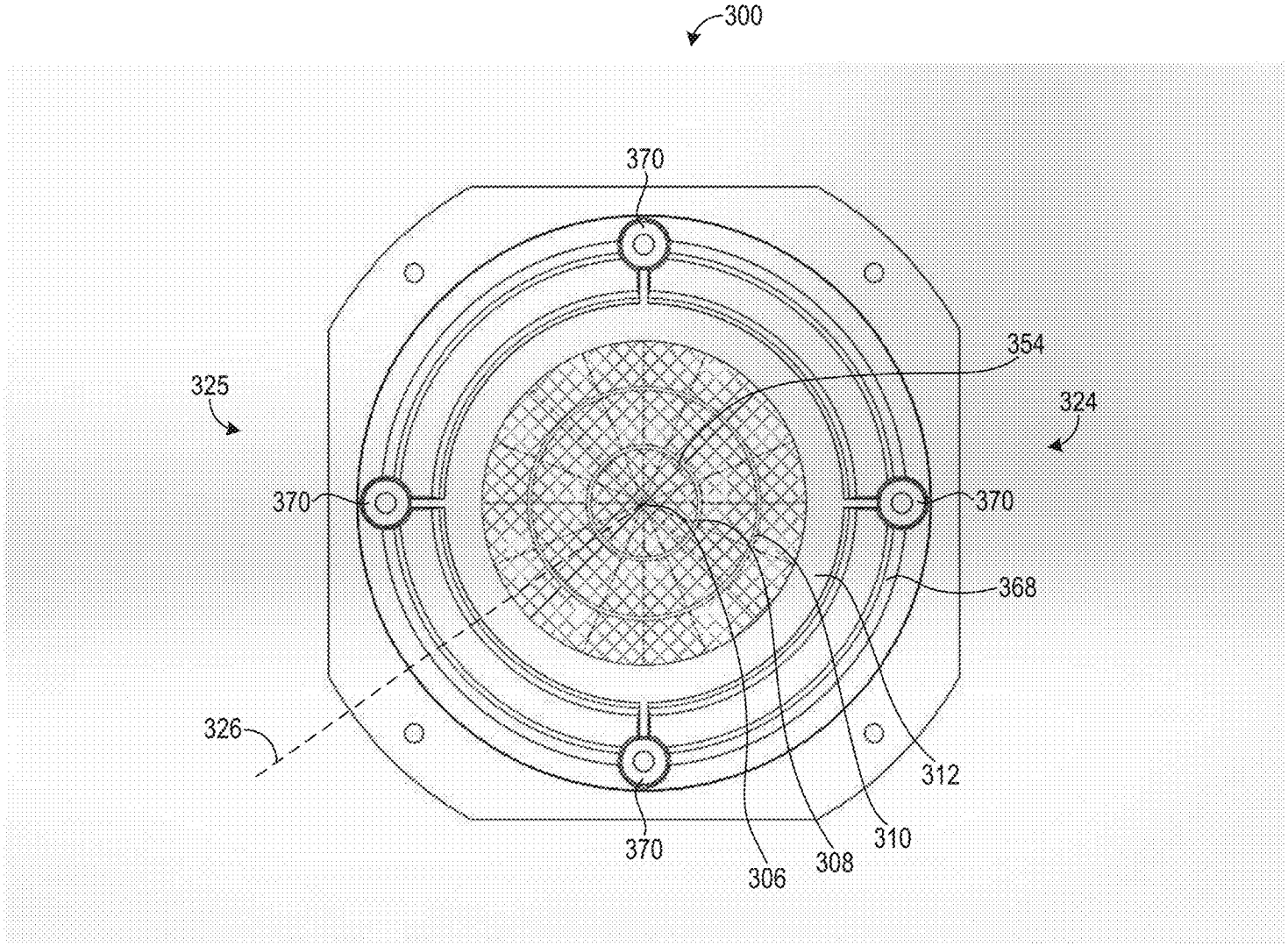

FIG. 3E shows a bottom view of phasing plug 300 and its bottom surface 324 at outlet side 325. Bottom surface 324 includes solid annular portions (with the exception of innermost portion 306 having a circular bottom surface) separated by hollow annular apertures 330, emphasized in the figure via crosshatching for clarity. The radial distance along radial axis 326 separating innermost portion 306 from second innermost portion 308 may be approximately equal to the radial distance separating the second innermost portion from second outermost portion 310. Conversely, in the depicted embodiment the radial distance separating second outermost portion 310 from outermost portion 312 is relatively smaller than the aforementioned radial distances. Moreover, the radial length along radial axis 326 of innermost portion 306, second innermost portion 308, and second outermost portion 310 may be approximately equal, whereas in this embodiment the radial length of outermost portion 312 is substantially (e.g., five times) greater than such radial lengths, imbuing phasing plug 300 with three portions being relatively thin in their radial dimension at outlet side 325 relative to the relatively thick outermost portion.

At bottom surface 324, the nadirs (e.g., lower surfaces) of portions 302 as measured along central axis 304 may be flush, such that a virtual plane including such nadirs is formed at the bottom surface. In other embodiments, such nadirs may be unequal, however. Moreover, triangular openings 354 described above are apparent in the bottom view shown in FIG. 3E.

Figure 3F:
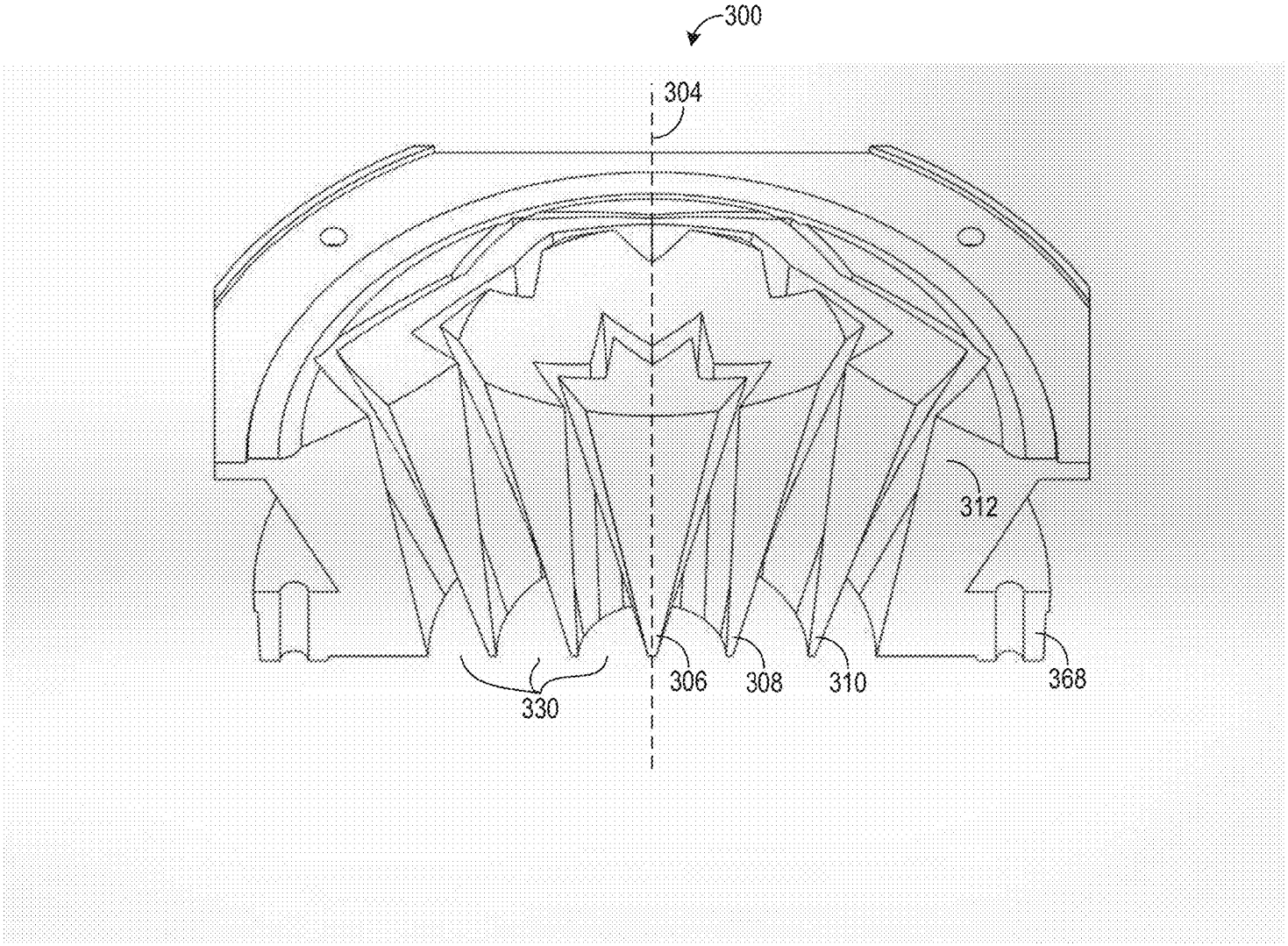
Figure 3G:
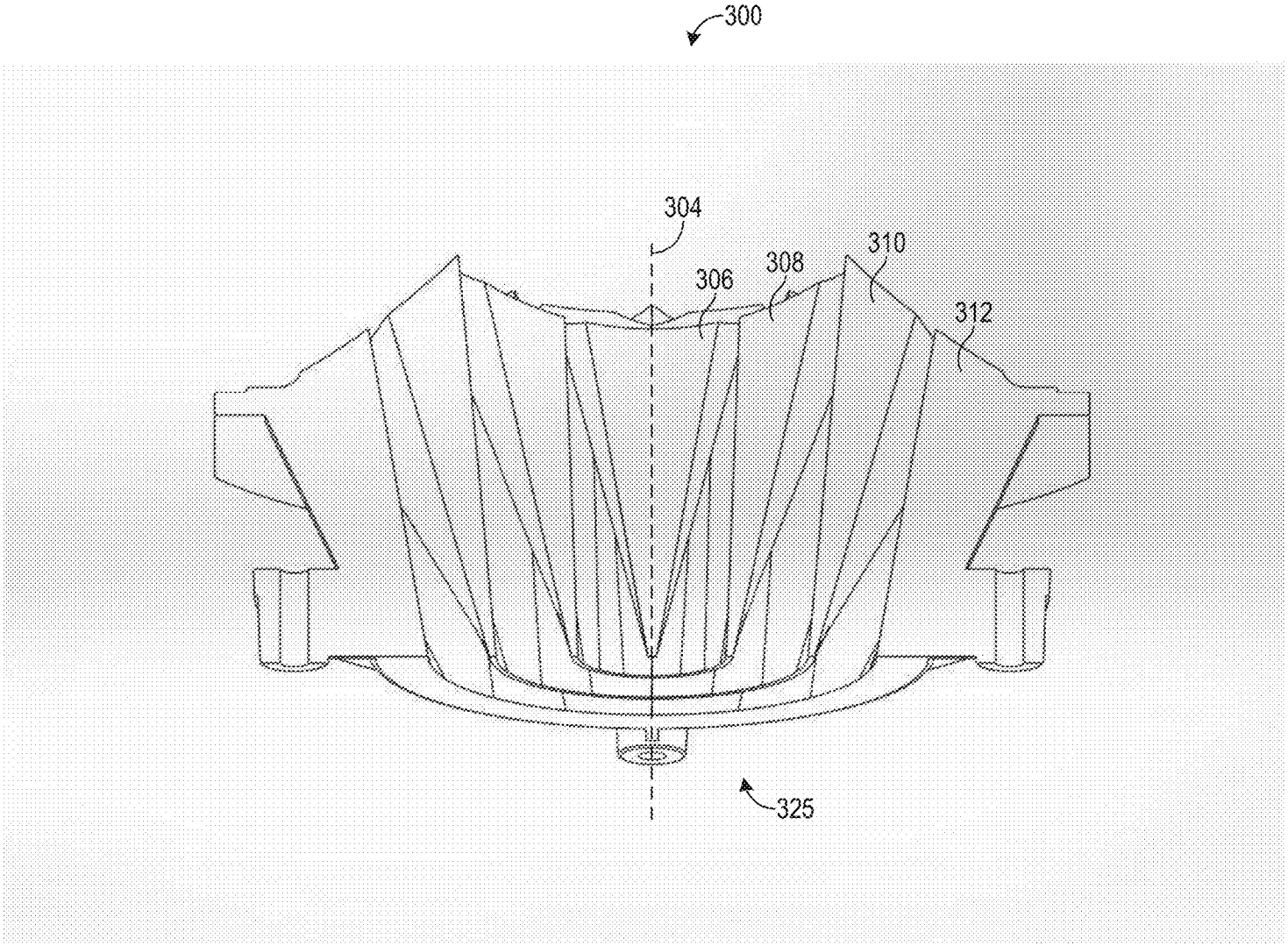

Turning now to FIG. 3F, a top-front perspective view of a cross-section of phasing plug 300 taken along line B-B in FIG. 3D is shown. As shown, the cross-sectional area of portions 302 generally decreases in a conical manner as central axis 304 is traversed downwardly. The respective rates of decrease in cross-sectional area for innermost portion 306, second innermost portion 308, and second outermost portion 310 may be approximately constant throughout the height of phasing plug 300. Relative to the cross-sectional areas of its neighboring portions 302, the cross-sectional area of innermost portion 306 decreases at a faster rate, while the rate of decrease in the cross-sectional areas of second innermost portion 308 and second outermost portion 310 are somewhat similar. Outermost portion 312 displays a varying rate of change in its cross-sectional area, however, decreasing in an approximately conical manner, and then increasing due to its connection to mount 368. While outermost portion 312 is shown as being contiguous with mount 368 in FIG. 3F, it will be appreciated that hollow portions may separate these two elements at some locations within phasing plug 300, as seen in FIG. 3D. FIG. 3G shows a bottom-front perspective view of the cross-section of phasing plug 300 taken along line B-B in FIG. 3D, and further illustrates the aspects mentioned above. As with phasing plug 200, the path-lengths of apertures 330 (a path-length for a given aperture being the distance along which acoustic waves travel in that aperture, for example) may be substantially equal (e.g., within several millimeters).

Figure 4A:
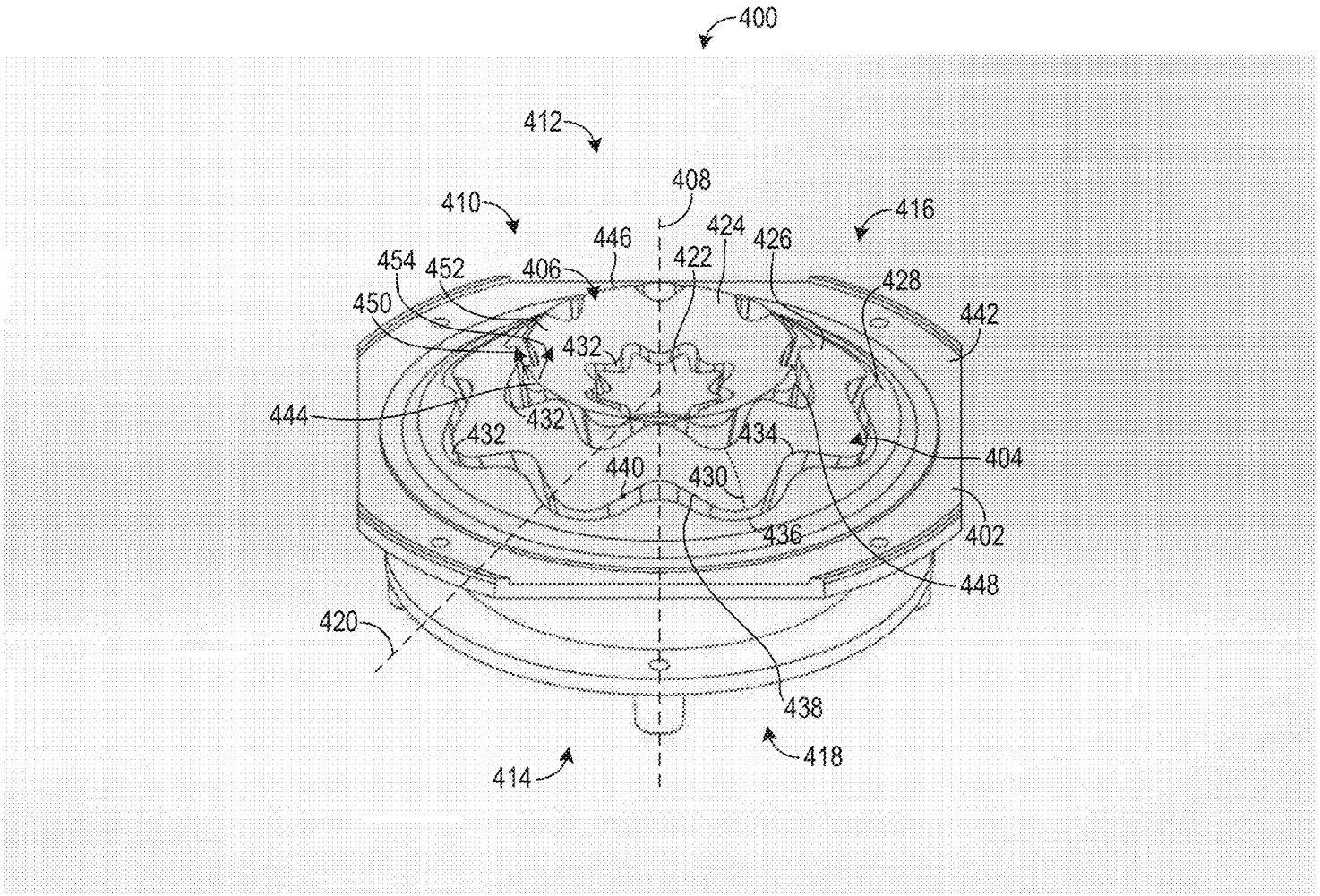
FIGS. 4A-F show various views of another phasing plug in accordance with one or more embodiments of the present disclosure.

FIGS. 4A-F show various views of another phasing plug 400 in accordance with one or more embodiments of the present disclosure. FIG. 4A particularly shows a top-front perspective view of phasing plug 400 including a top 402 that is generally shaped to match the shape of a diaphragm proximate which it is to be placed; in this example the top is generally convex in a first annular region 404 and generally concave in a second annular region 406 that extends from a central axis 408, the second annular region being further radially inward than the first annular region. Such a configuration is adapted to a concave diaphragm having a convex and generally spherical or parabolic dome or dust cap. The area spanned by first and second annular regions 404 and 406, as well as the degree to which these regions are respectively convex and concave, may be varied to suit various diaphragms.

Phasing plug 400 includes four solid portions 410 that are at least approximately concentrically aligned with one another with respect to central axis 408 extending from an inlet side 412 to an outlet side 414 of the phasing plug and along its center. Collectively, portions 410 form a front surface 416, extending therefrom and forming a bottom surface 418 described below. Proceeding outward from a radial axis 420 extending from central axis 408, portions 410 comprise an innermost portion 422, a second innermost portion 424, a second outermost portion 426, and an outermost portion 428. With the exception of innermost portion 422, portions 410 are partially annular. Moreover, portions 410 are symmetric for slices across the entire diameter of phasing plug 400 along radial axis 420 (or for any other radial axis perpendicular to and intersecting central axis 408). In some embodiments, portions 410 may span approximately equal geodesic lengths of front surface 416—e.g., as measured along a geodesic 430. Portions 422, 424, 426, and 428 may be held in place by one or more structures (not shown)—e.g., mechanical bridges extending at least partially radially across the portions.

As shown, adjacent pairs of portions 410 are separated by apertures or slots 432. Like portions 410, apertures 432 span the vertical length of phasing plug 400 (e.g., as measured along central axis 408) from front surface 416 and inlet side 412 to bottom surface 418 and outlet side 414. In the depicted embodiment, apertures 432 comprise three apertures that may be evenly distributed across front surface 416 (e.g., as measured along a geodesic extending from central axis 408 to the outer perimeter of top 402), though their spatial distribution may be asymmetric in other embodiments. The numbers of portions and apertures shown are provided as non-limiting examples, however, and are not intended to be limiting in any way.

Each aperture 432 exhibits a generally meandering, flexuous, and/or anfractuous pattern that regularly repeats circumferentially along front surface 416. Unlike the aperture and portion perimeter patterns of phasing plugs 200 and 300, however, the aperture patterns of phasing plug 400 generally vary in an undulating approximately sinuous pattern resembling a sinusoid (e.g., a sinusoidal pattern), being relatively more smoothly curved and lacking sharp, angular bends. In this example, the patterns include eight peaks (e.g., peak 434) and eight troughs (e.g., trough 436) separated by intervening curved segments (e.g., segment 438). In some embodiments, the patterns may differ from a typical sinusoid by a percentage difference, for example—e.g., 10-20%. In other embodiments, however, the patterns may be exactly sinusoidal. Further, other numbers of peaks 434 and troughs 436 are possible without departing from the scope of this disclosure. In some embodiments, segments 438 may exhibit two regions of differing curvature separated approximately at its midpoint by an inflection point (e.g., inflection point 440). In some embodiments, the number of peaks 434 and/or troughs 436 may differ for different apertures 432. Due to their intervening placement, apertures 432 define generally meandering, flexuous, and/or anfractuous perimeters for each of portions 410; with the exception of outermost portion 428 which has a circular outer perimeter encompassed by a frame 442 (which has a partially circular perimeter interrupted by straight beveled segments similar to that of frame 314) and innermost portion 422 which lacks an inner perimeter, the remaining portions have inner and outer perimeters that exhibit such a pattern.

In some embodiments, the geodesic length of each aperture 432 may be constant as top 402 is traversed circumferentially, though in other embodiments this length may be unequal—for example, a greater geodesic length may exist between adjacent peaks 434 than at adjacent troughs 436. In the configuration depicted in FIG. 4B, the geodesic length of the outermost aperture 432 (interposed between outermost portion 428 and second innermost portion 426) regularly varies from peak 434 to trough 436, reaching a maximum at the former and falling to a minimum at the latter. Geodesic lengths may further vary for other apertures 432.

In this embodiment, apertures 432 and their patterns are symmetric for slices across the entire diameter of phasing plug 400 along radial axis 420 such that each portion 410 exhibits the same general meandering inner and/or outer perimeter, though the perimeter patterns scale down as top 402 is traversed radially inward toward innermost portion 422 (e.g., the lengths of segments 438 decrease for an aperture 432 that is closer to central axis 408 than for an aperture that is farther away from the central axis). Further, apertures 432 and the inner and/or outer perimeter patterns of portions 410 may be geodesically aligned—for example, peaks 434 of adjacent (two or more) apertures intersect along geodesic 430.

FIG. 4A also illustrates variation in the surface of second innermost portion 424. Specifically, second innermost portion 424 includes a first surface region falling within first annular region 404 that comprises eight convex wedge-shaped sections (e.g., section 444) regularly spaced around a meandering boundary 446 with portions of the meandering boundary interposed between adjacent pairs of the portions. Tips (e.g., tip 448) of sections 444 define the regions of second innermost portion 424 that are most radially outward from central axis 408. Sections 444 may be defined by respective first surface normals such as first surface normal 450 having an angle of +30° relative to central axis 408, for example. Conversely, meandering boundary 446 also defines, within its interior, a second surface region falling within second annular region 406 that comprises a partially annular section 452 whose inner perimeter is defined by the inner perimeter of second innermost portion 424. As partially annular section 452 exhibits varying curvature along radial axis 420, it may be defined by a plurality of second surface normals having various angles relative to central axis 408. In some embodiments, at a region immediately proximate a section 444, partially annular section 452 may be defined by a second surface normal 454 having an angle that is the additive inverse of the angle of first surface normal 450 (e.g., −30°), for example. Meandering boundary 446 thus separates two regions of different curvature.

Figure 4B:
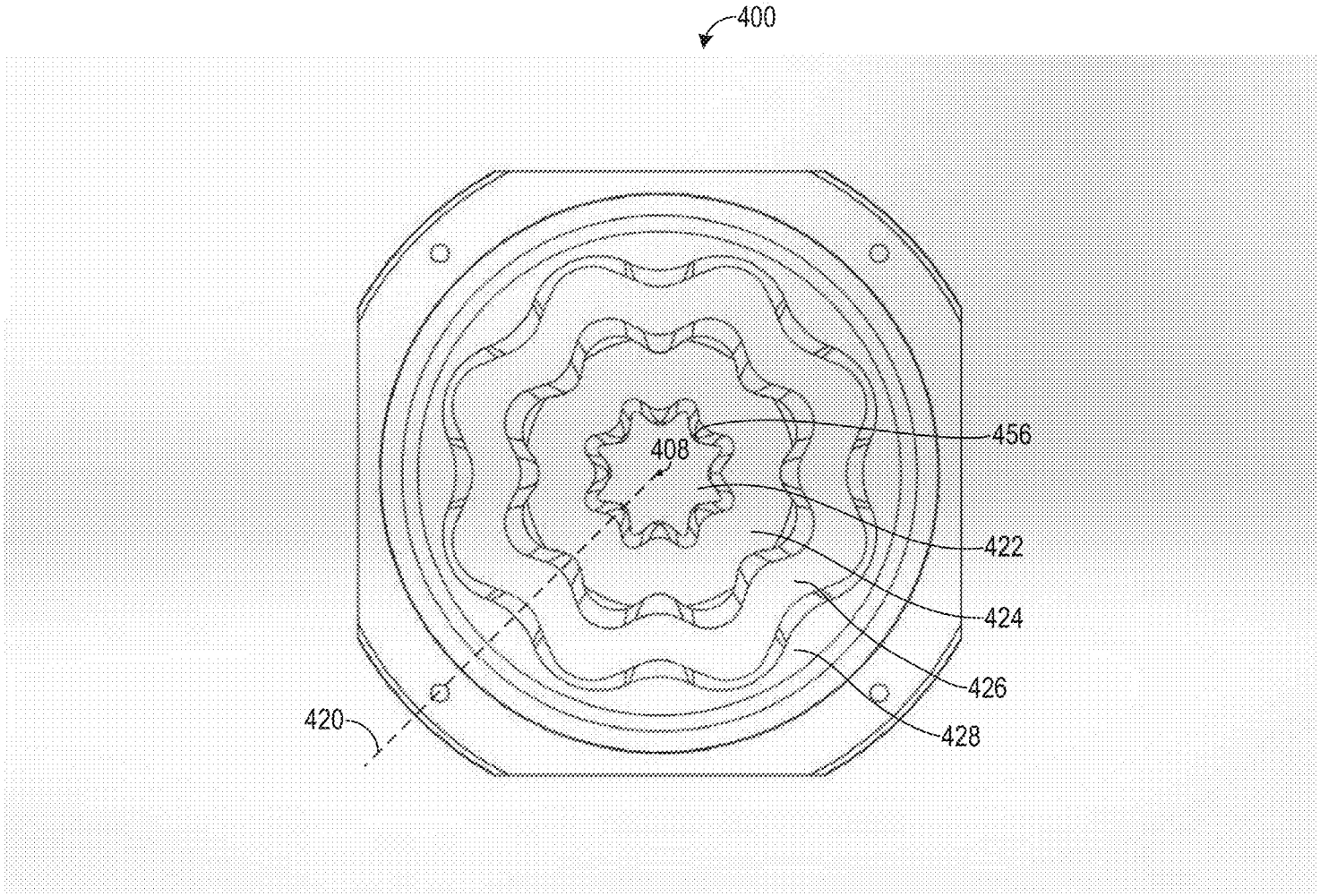

FIG. 4B shows a top view of phasing plug 400, illustrating some of the aforementioned aspects (e.g., radial symmetry, distribution of portions 410 and apertures 432 along front surface 416) in addition to others. As seen in this top view, portions 410 may occupy approximately the same radial lengths as measured along radial axis 420. Alternatively, portions 410 may occupy approximately the same geodesic lengths as measured along geodesic 430.

FIG. 4B also illustrates how a portion of apertures 432 may be visible from inlet side 412 to outlet side 414 throughout the entire vertical length of phasing plug 400 as seen from the top view. From this perspective, eight openings (e.g., opening 456) assuming a wedge shape may be apparent. Openings 456 may also appear wedge-shaped as seen from a bottom perspective as described below.

Figure 4C:
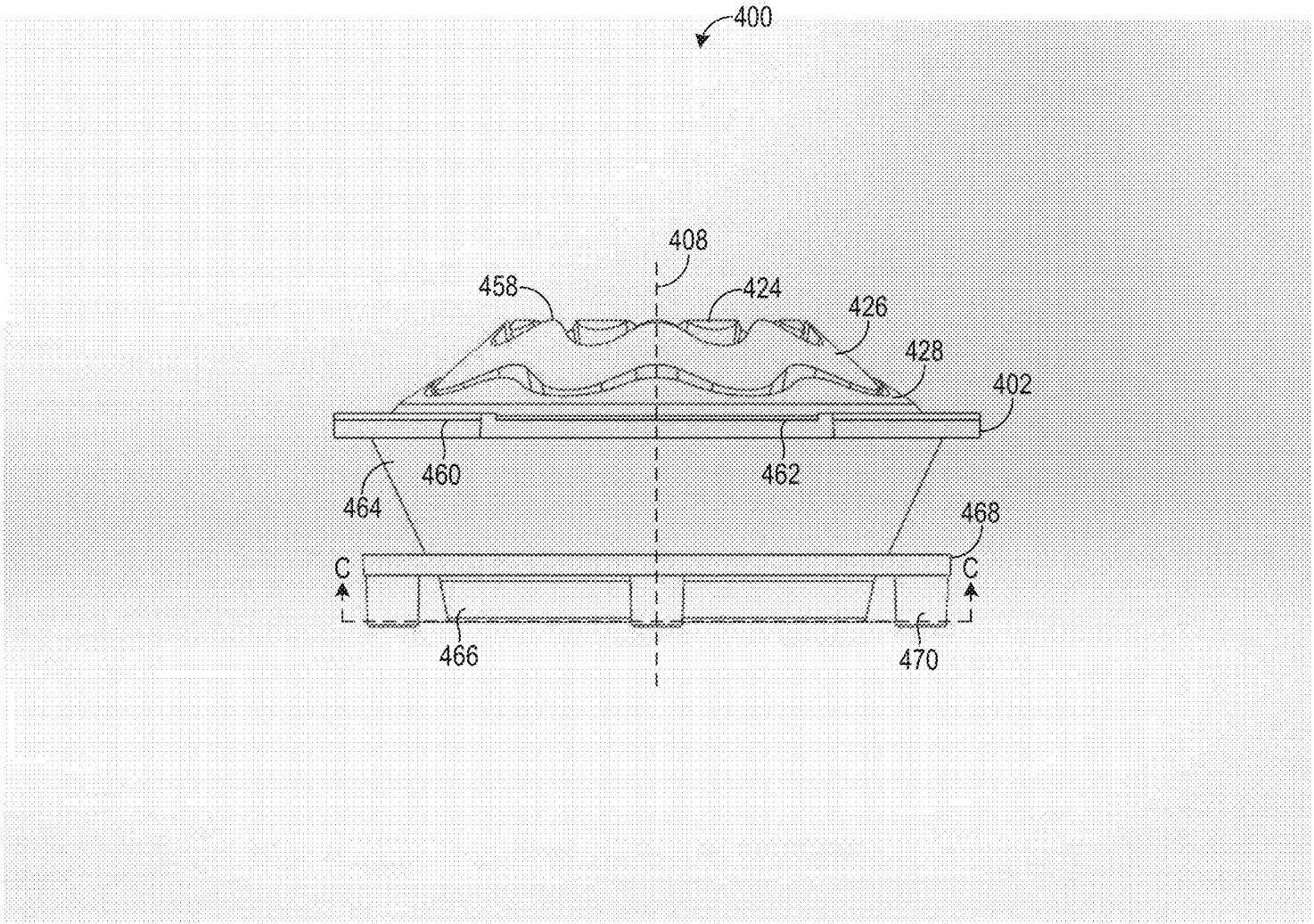

Turning now to FIG. 4C, a side view of phasing plug 400 is shown. As seen in this view, second outermost portion 424 reaches the highest point of phasing plug 400 at an apex 458 along central axis 408. In this configuration, apex 458 coincides with that of second innermost portion 426, forming a virtual plane including the apexes of both the second outermost portion 424 and the second innermost portion, the apexes being separated from one another along a horizontal axis (not shown) extending across the diameter of phasing plug 400 and perpendicular to central axis 408. In other embodiments, however, the apexes of second outermost portion 424 and second innermost portion 426 may be horizontally separated from one another along central axis 408, as with the apexes of the second outermost and innermost portions of phasing plug 300 in FIG. 3.

Top 402 includes a first chamfer 460 along the circular portion of its outer perimeter and a second chamfer 462 along the straight beveled portion of its outer perimeter that is horizontally separated from the first ridge. The beveled portion reaches a slightly lower height along central axis 408 than that of the circular portion. At its bottom side, top 402 is coupled to a midsection 464 whose outer perimeter may at least partially defined by outermost portion 428, decreasing in a linear, conical fashion as central axis 408 is traversed downwardly such that its diameter assumes a larger value at a first height along the central axis than that at a second, lower height along the central axis. The uppermost portion of midsection 464 is joined to the bottom side of top 402 at a distance radially inward from the outer perimeter of the top such that the top partially overhangs the midsection. Midsection 464 may assume non-conical geometries without departing from the scope of this disclosure, however.

At a midsection boundary, midsection 464 couples to a bottom 466 whose cross-sectional area decreases along central axis 408 at a rate less than that of the midsection with respect to slicing planes perpendicular to the central axis. It will be appreciated that the height of bottom 466, measured along central axis 408, may be varied without departing from the scope of this disclosure. In other embodiments, bottom 466 may be omitted, in which case phasing plug 400 and apertures 432 may terminate at the midsection boundary. A mount 468, which may be separately or integrally formed with bottom 466, surrounds the bottom in an approximately concentric manner. Mount 468 is partially annular and, in this example, includes four projections (e.g., projection 470) each having cylindrical bores through which various types of fasteners (e.g., screws) may be inserted to securely affix phasing plug 400 in a surrounding environment.

Figure 4D:
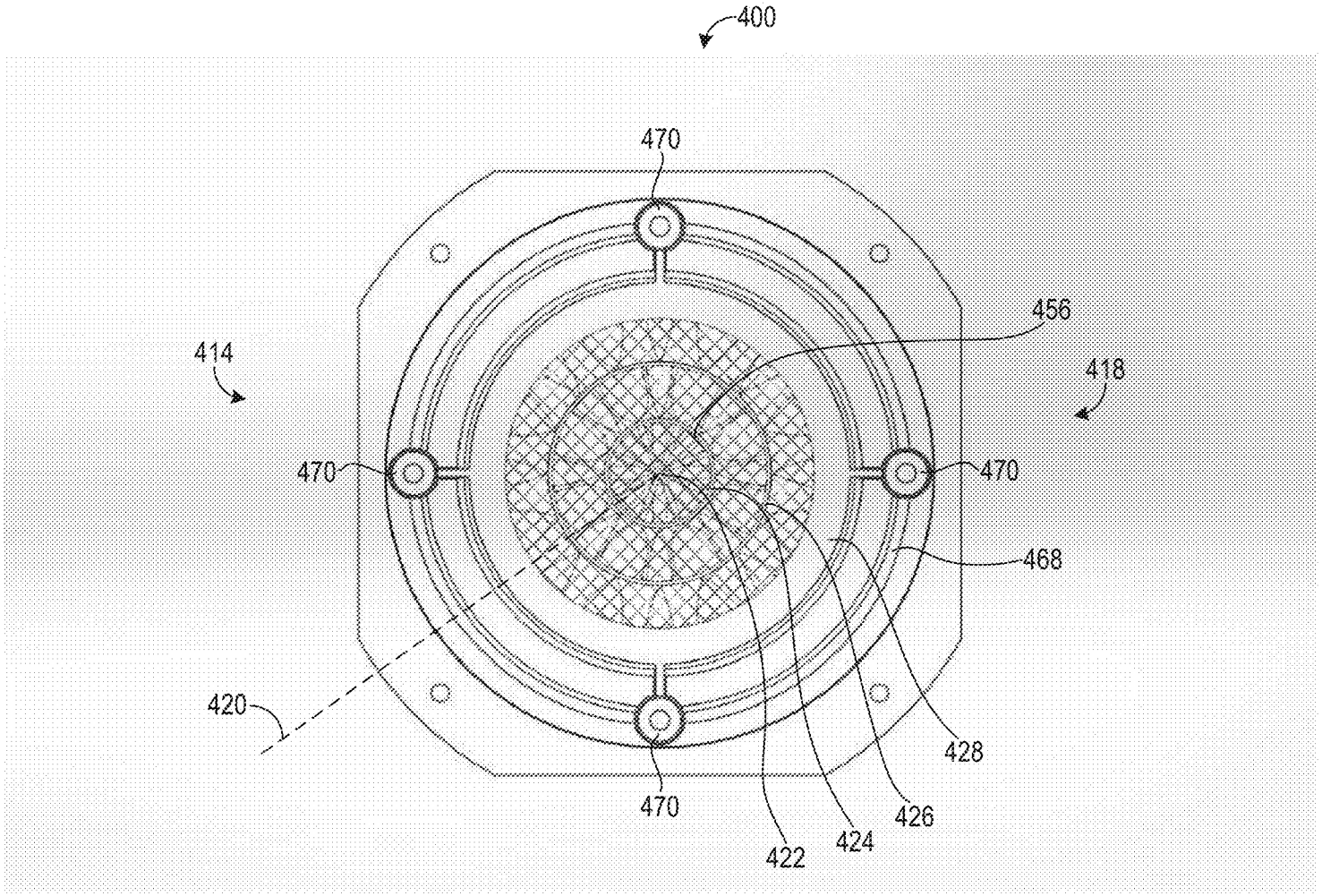

FIG. 4D shows a bottom view of phasing plug 400 and its bottom surface 418 at outlet side 414. Bottom surface 418 includes solid annular portions (with the exception of innermost portion 422 having a circular bottom surface) separated by hollow annular apertures 432, emphasized in the figure via crosshatching for clarity. The radial distance along radial axis 420 separating innermost portion 422 from second innermost portion 424 may be approximately equal to the radial distance separating the second innermost portion from second outermost portion 426. Conversely, in the depicted embodiment the radial distance separating second outermost portion 426 from outermost portion 428 is relatively smaller than the aforementioned radial distances. Moreover, the radial length along radial axis 420 of innermost portion 422, second innermost portion 424, and second outermost portion 426 may be approximately equal, whereas in this embodiment the radial length of outermost portion 428 is substantially (e.g., five times) greater than such radial lengths, imbuing phasing plug 400 with three portions being relatively thin in their radial dimension at outlet side 414 relative to the relatively thick outermost portion.

At bottom surface 418, the nadirs (e.g., lower surfaces) of portions 410 as measured along central axis 304 may be flush, such that a virtual plane including such nadirs is formed at the bottom surface. In other embodiments, such nadirs may be unequal, however. Moreover, wedge openings 456 described above are apparent in the bottom view shown in FIG. 4D.

Figure 4E:
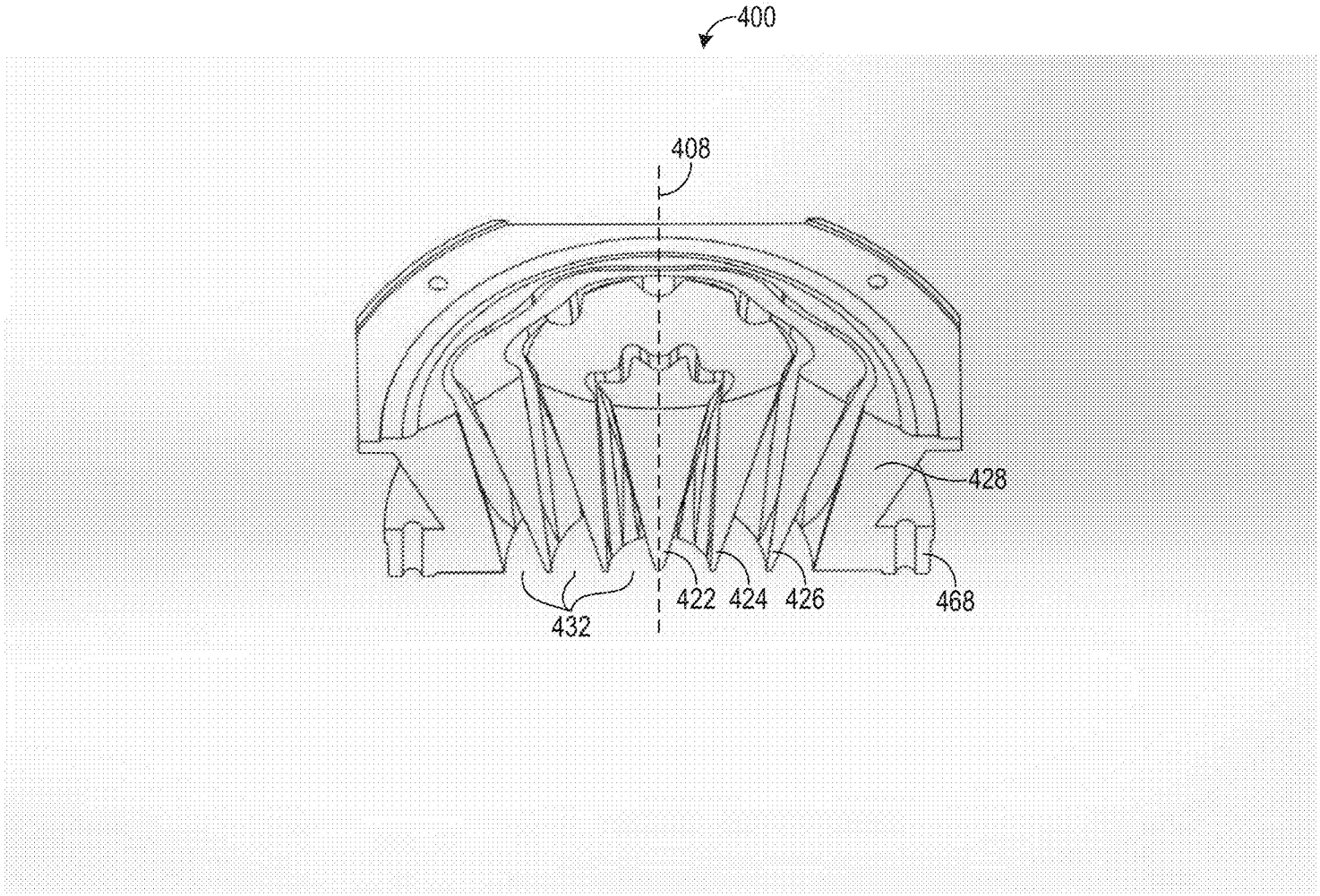
Figure 4F:
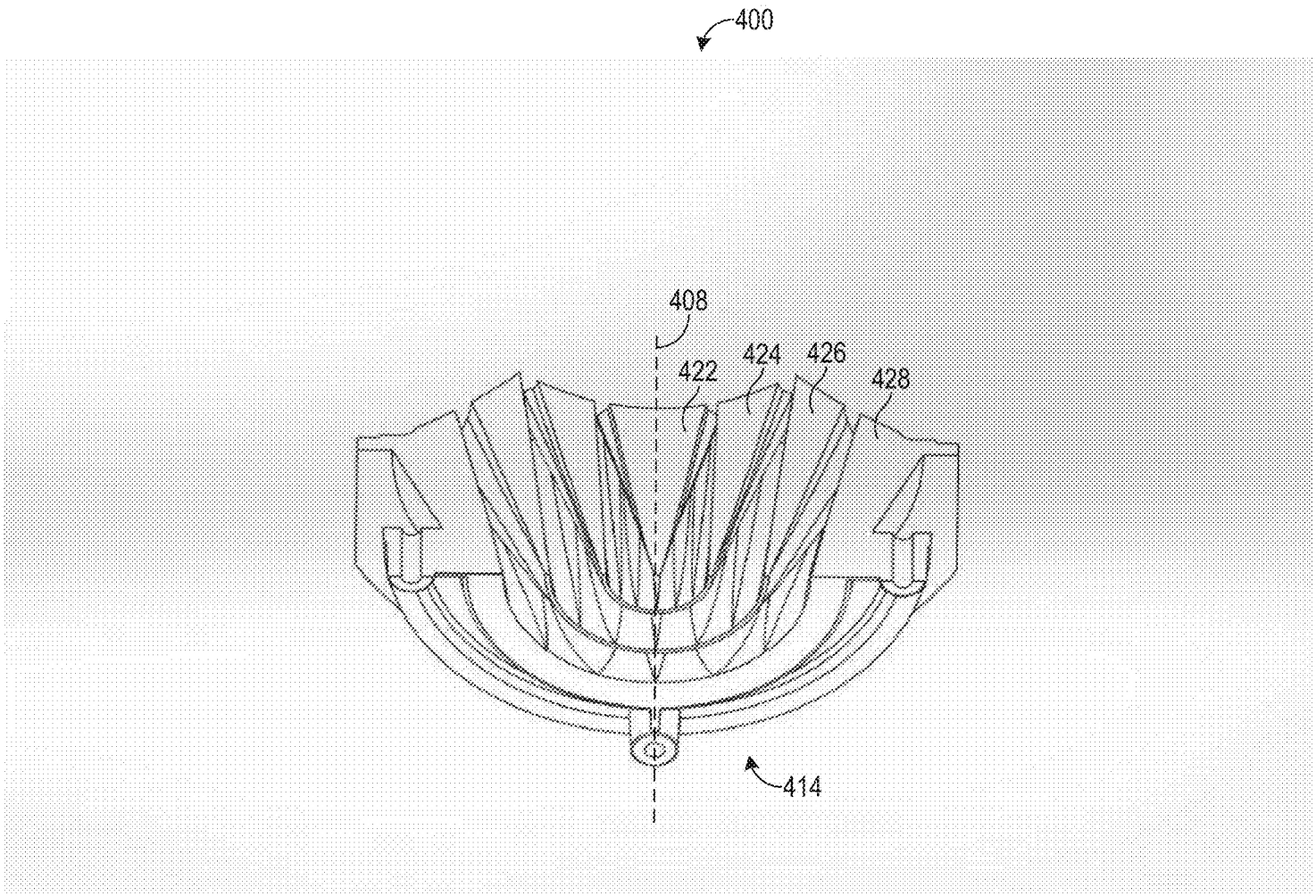

Turning now to FIG. 4E, a top-front perspective view of a cross-section of phasing plug 400 taken along line C-C in FIG. 4C is shown. As shown, the cross-sectional area of portions 410 generally decreases in a conical manner as central axis 408 is traversed downwardly. The respective rates of decrease in cross-sectional area for innermost portion 422, second innermost portion 424, and second outermost portion 426 may be approximately constant throughout the height of phasing plug 400. Relative to the cross-sectional areas of its neighboring portions 410, the cross-sectional area of innermost portion 422 decreases at a faster rate, while the rate of decrease in the cross-sectional areas of second innermost portion 424 and second outermost portion 426 are somewhat similar. Outermost portion 428 displays a varying rate of change in its cross-sectional area, however, decreasing in an approximately conical manner, and then increasing due to its connection to mount 468. While outermost portion 428 is shown as being contiguous with mount 468 in FIG. 4E, it will be appreciated that hollow portions may separate these two elements at some locations within phasing plug 400, as seen in FIG. 4C. FIG. 4F shows a bottom-front perspective view of the cross-section of phasing plug 400 taken along line C-C in FIG. 4C, and further illustrates the aspects mentioned above. As with phasing plug 200, the path-lengths of apertures 432 (a path-length for a given aperture being the distance along which acoustic waves travel in that aperture, for example) may be substantially equal (e.g., within several millimeters).

Figure 5A:
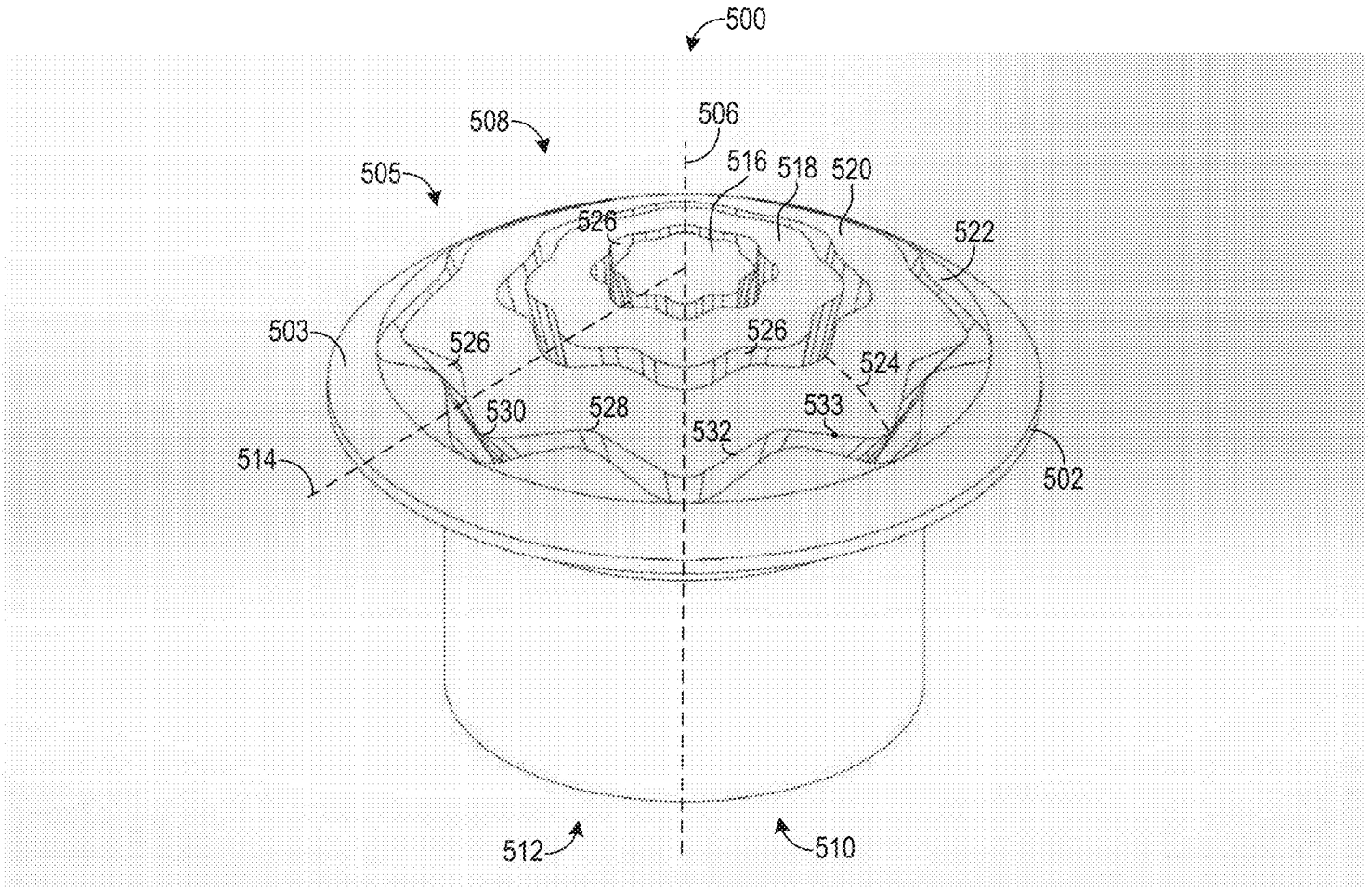
FIGS. 5A-C show various views of another phasing plug in accordance with one or more embodiments of the present disclosure.
Figure 5B:
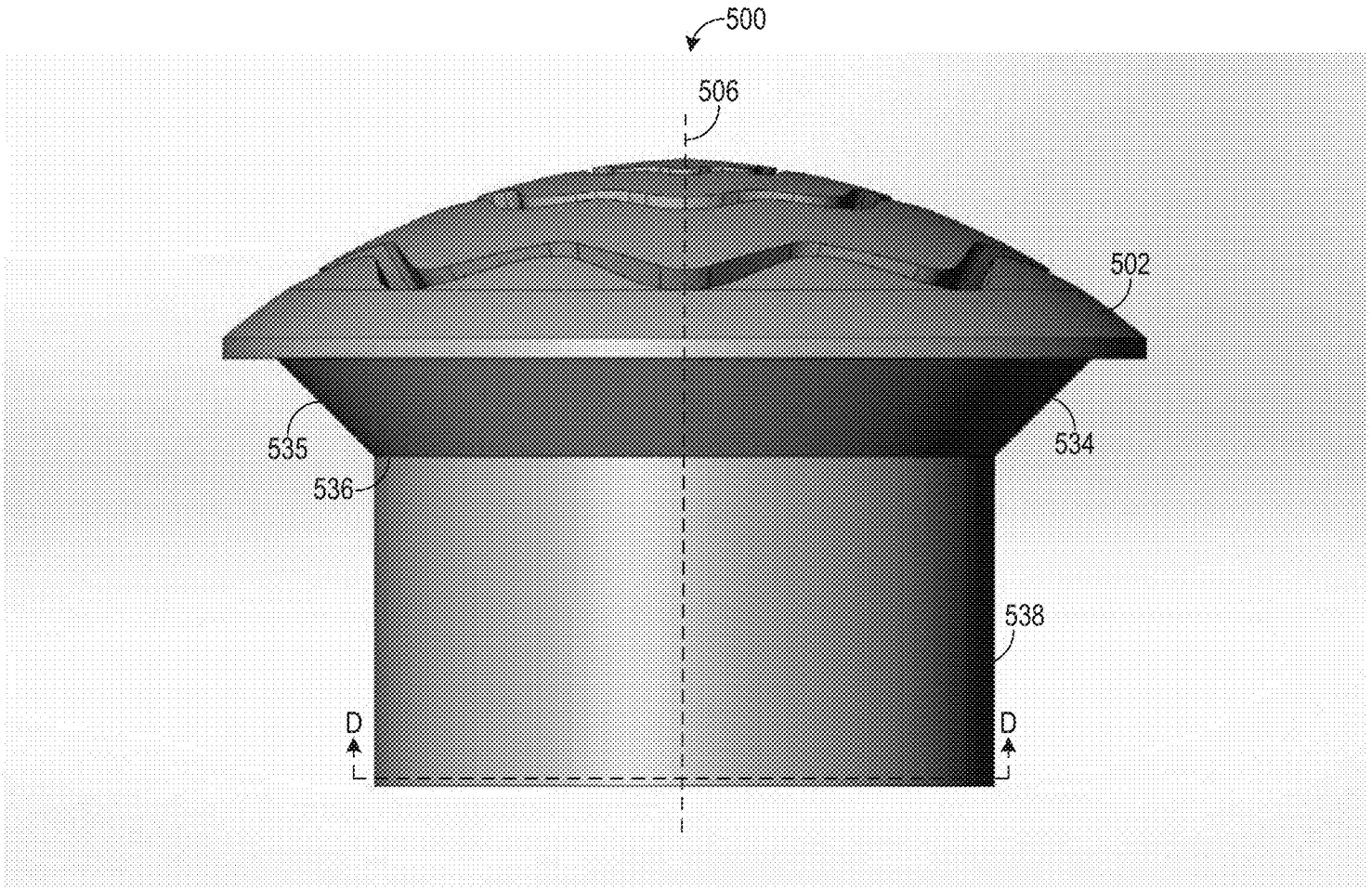
Figure 5C:
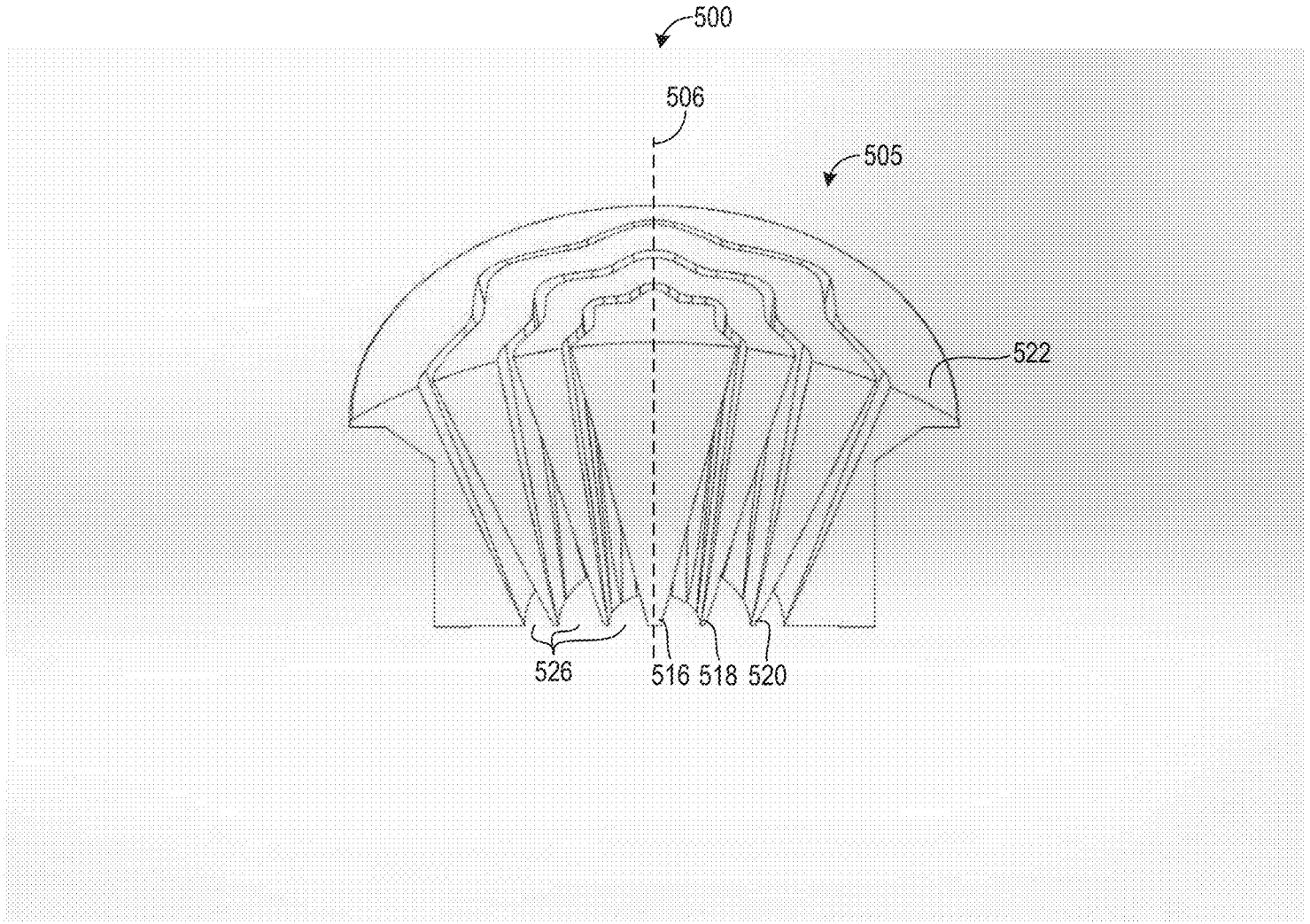

FIGS. 5A-C show various views of another phasing plug 500 in accordance with one or more embodiments of the present disclosure. As seen in the top-front perspective view shown in FIG. 5A, phasing plug 500 includes a top 502 that is generally shaped to match the shape of a diaphragm proximate which it is to be placed; in this example the top is generally convex and approximately hemispherical, having a front surface 503 contoured to a generally concave diaphragm lacking a dome or dust cap such as diaphragm 112 of FIG. 1. The degree to which top 502 is convexly curved may be modified to match its proximate diaphragm, however.

Phasing plug 500 includes four solid portions 505 that are at least approximately concentrically aligned with one another with respect to a central axis 506 extending from an inlet side 508 to an outlet side 510 of the phasing plug and along its center. Collectively, portions 505 form front surface 503, extending therefrom and forming a bottom surface 512. Proceeding outward from a radial axis 514 extending from central axis 506, portions 505 comprise an innermost portion 516, a second innermost portion 518, a second outermost portion 520, and an outermost portion 522, which collectively decrease in height with respect to central axis 506 in a smooth, gradual manner. With the exception of innermost portion 516, portions 505 are partially annular. In this example, portions 505 are approximately convex and symmetric for slices across the entire diameter of phasing plug 500 along radial axis 514 (or for any other radial axis perpendicular to and intersecting central axis 506). In some embodiments, portions 505 may span approximately equal geodesic lengths of front surface 503—e.g., as measured along a geodesic 524. Alternatively, portions 505 may span approximately equal radial lengths as measured along radial axis 514. Portions 516, 518, 520, and 522 may be held in place by one or more structures (not shown)—e.g., mechanical bridges extending at least partially radially across the portions.

As shown, adjacent pairs of portions 505 are separated by apertures or slots 526 that provide hollow portions through which acoustic waves may travel and further form front surface 503. Like portions 505, apertures 526 span the vertical length of phasing plug 500 (e.g., as measured along central axis 506) from front surface 503 and inlet side 508 to bottom surface 512 and outlet side 510. In the depicted embodiment, apertures 526 comprise three apertures that may be evenly distributed across front surface 503 (e.g., as measured along a geodesic extending from central axis 506 to outer perimeter 507 of top 502), though their spatial distribution may be asymmetric in other embodiments. The numbers of portions and apertures shown are provided as non-limiting examples, however, and are not intended to be limiting in any way.

Each aperture 526 exhibits a generally meandering, flexuous, and/or anfractuous pattern that regularly repeats circumferentially along front surface 503. As with the aperture and portion perimeter patterns of phasing plug 400, the aperture patterns of phasing plug 500 generally vary in an undulating approximately sinuous pattern resembling a sinusoid (e.g., a sinusoidal pattern), being relatively more smoothly curved and lacking sharp, angular bends. In this example, the patterns include eight peaks (e.g., peak 528) and eight troughs (e.g., trough 530) separated by intervening curved segments (e.g., segment 532). In some embodiments, the patterns may differ from a typical sinusoid by a percentage difference, for example—e.g., 10-20%. In other embodiments, however, the patterns may be exactly sinusoidal. Further, other numbers of peaks 528 and troughs 530 are possible without departing from the scope of this disclosure. In some embodiments, segments 532 may exhibit two regions of differing curvature separated approximately at its midpoint by an inflection point (e.g., inflection point 533). In some embodiments, the number of peaks 528 and/or troughs 530 may differ for different apertures 526. Due to their intervening placement, apertures 526 define generally meandering, flexuous, and/or anfractuous perimeters for each of portions 505; with the exception of outermost portion 522, which has a circular outer perimeter, and innermost portion 516 which lacks an inner perimeter, the remaining portions have inner and outer perimeters that exhibit such a pattern. In some embodiments, the geodesic length of each aperture 526 may be constant as top 502 is traversed circumferentially, though in other embodiments this length may be unequal—for example, a greater geodesic length may exist between adjacent peaks 528 than at adjacent troughs 530. Such geodesic lengths may further vary for given apertures 526.

In this embodiment, apertures 526 and their patterns are symmetric for slices across the entire diameter of phasing plug 500 along radial axis 514 such that each portion 505 exhibits the same general meandering inner and/or outer perimeter, though the perimeter patterns scale down as top 502 is traversed radially inward toward innermost portion 516 (e.g., the lengths of segments 532 decrease for an aperture 526 that is closer to central axis 506 than for an aperture that is farther away from the central axis). Further, apertures 526 and the inner and/or outer perimeter patterns of portions 505 may be geodesically aligned—for example, peaks 528 of adjacent (two or more) apertures intersect along geodesic 524.

FIG. 5B shows a side view of phasing plug 500. The outer surface of phasing plug 500 as well as the surfaces of portions 505 defined by apertures 526 are shaded in FIG. 5 to further illustrate the physical configuration of the phasing plug. As shown, top 502 is coupled at its bottom side to a midsection 534 having an outer perimeter 535 defined by outermost portion 522, decreasing in a linear, conical fashion as central axis 506 is traversed downwardly such that its diameter assumes a larger value at a first height along the central axis than that at a second, lower height along the central axis. The uppermost portion of midsection 534 is joined to the bottom side of top 502 at a distance radially inward from the outer perimeter of the top such that the top partially overhangs the midsection. From the perspective of FIG. 5B, this configuration generally imbues phasing plug 500 with what is referred to herein as a "mushroom" shape. Midsection 534 may assume non-conical geometries without departing from the scope of this disclosure, however.

At a midsection boundary 536, midsection 534 couples to a cylindrical bottom 538 whose cross-sectional area is approximately constant along central axis 506, with respect to slicing planes perpendicular to the central axis. Collectively, top 502, midsection 534, and bottom 538 each house respective subsets of portions 505. More particularly, as outermost portion 522 extends from front surface 503 to bottom surface 512, the outermost portion may be considered to define the overall outer perimeter and surface of phasing plug 500, as well as what be referred to as a "frame", the frame comprising the portion of the phasing plug extending from its outer surface radially inward to the most radially outward aperture 526—e.g., the solid portion of the phasing plug that is outwardly bounded by this aperture. It will be appreciated that the height of bottom 538, measured along central axis 506, may be varied without departing from the scope of this disclosure. In other embodiments, bottom 538 may be omitted, in which case phasing plug 500 and apertures 526 may terminate at midsection boundary 536 of midsection 534.

While not shown, portions 505 may define bottom surface 512 which includes solid annular portions (with the exception of innermost portion 516 having a circular bottom surface) separated by hollow annular apertures 526. As with front surface 503, portions 505 may be equally spaced from one another with respect to radial axis 514. Moreover, in some embodiments, the bottom surfaces of each portion 505 may be substantially flush (e.g., within 10 mm) along a plane perpendicular to central axis 506. Further, the radial lengths of second innermost portion 518 and second outermost portion 520 may be approximately equal, with the radial length of outermost portion 522 being relatively larger.

FIG. 5C shows a top-front perspective view of a cross-section of phasing plug 500 taken along line D-D in FIG. 5B. The variation in the cross-sectional area of portions 505 along central axis 506 is particularly illustrated. As shown, the cross-sectional area of portions 505 generally decreases in a conical manner as central axis 506 is traversed downwardly. The respective rates of decrease in cross-sectional area for innermost portion 516, second innermost portion 518, and second outermost portion 520 may be approximately constant throughout the height of phasing plug 500. Relative to the cross-sectional areas of its neighboring portions 505, the cross-sectional area of second outermost portion 520 decreases at a faster rate. Outermost portion 522 displays a somewhat constant rate of change in its cross-sectional area, however, notwithstanding a small region of relatively irregular cross-sectional variation proximate the bottom edge of top 502. As with phasing plug 200, the path-lengths of apertures 526 (a path-length for a given aperture being the distance along which acoustic waves travel in that aperture, for example) may be substantially equal (e.g., within several millimeters).

Figure 6A:
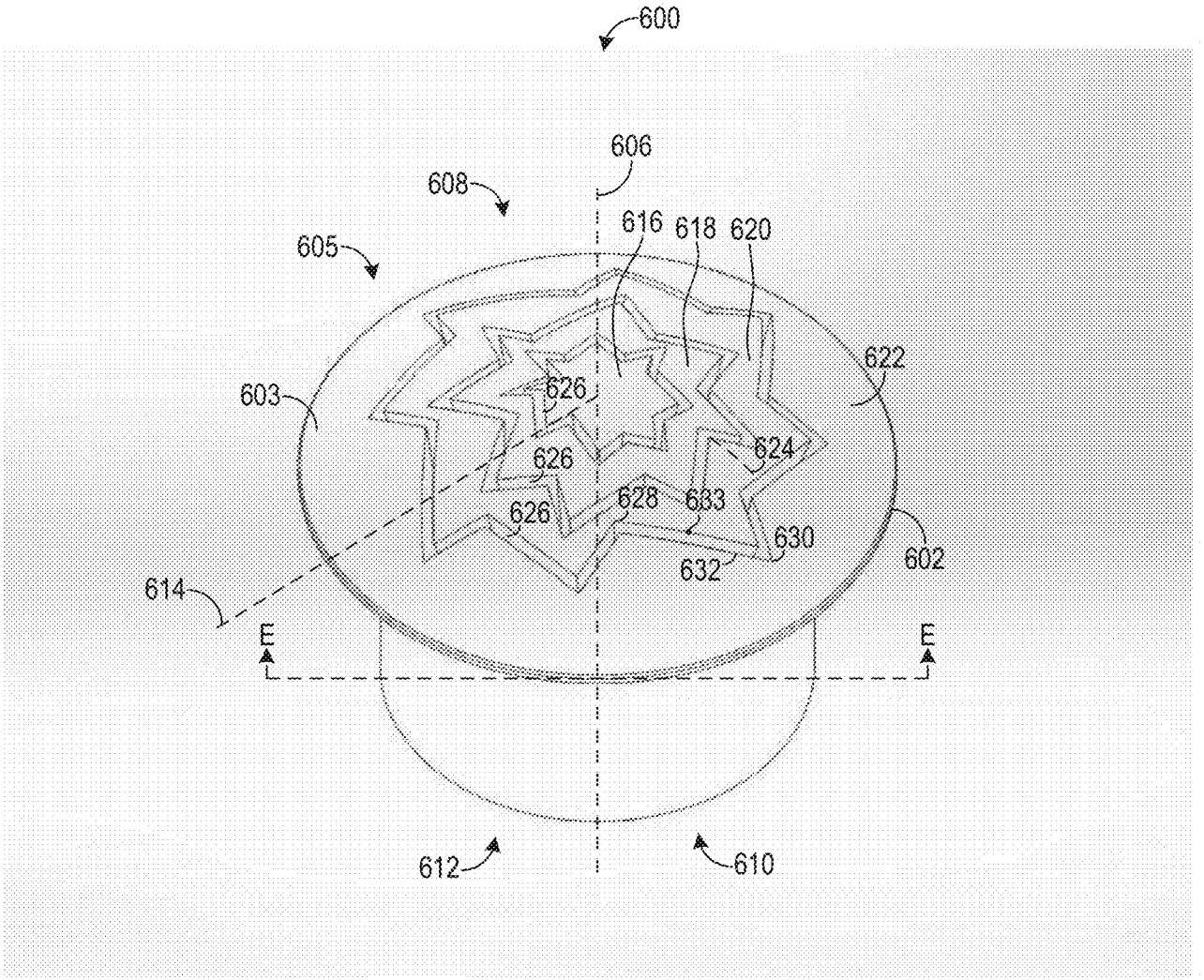
FIGS. 6A-B show various views of another phasing plug in accordance with one or more embodiments of the present disclosure.
Figure 6B:
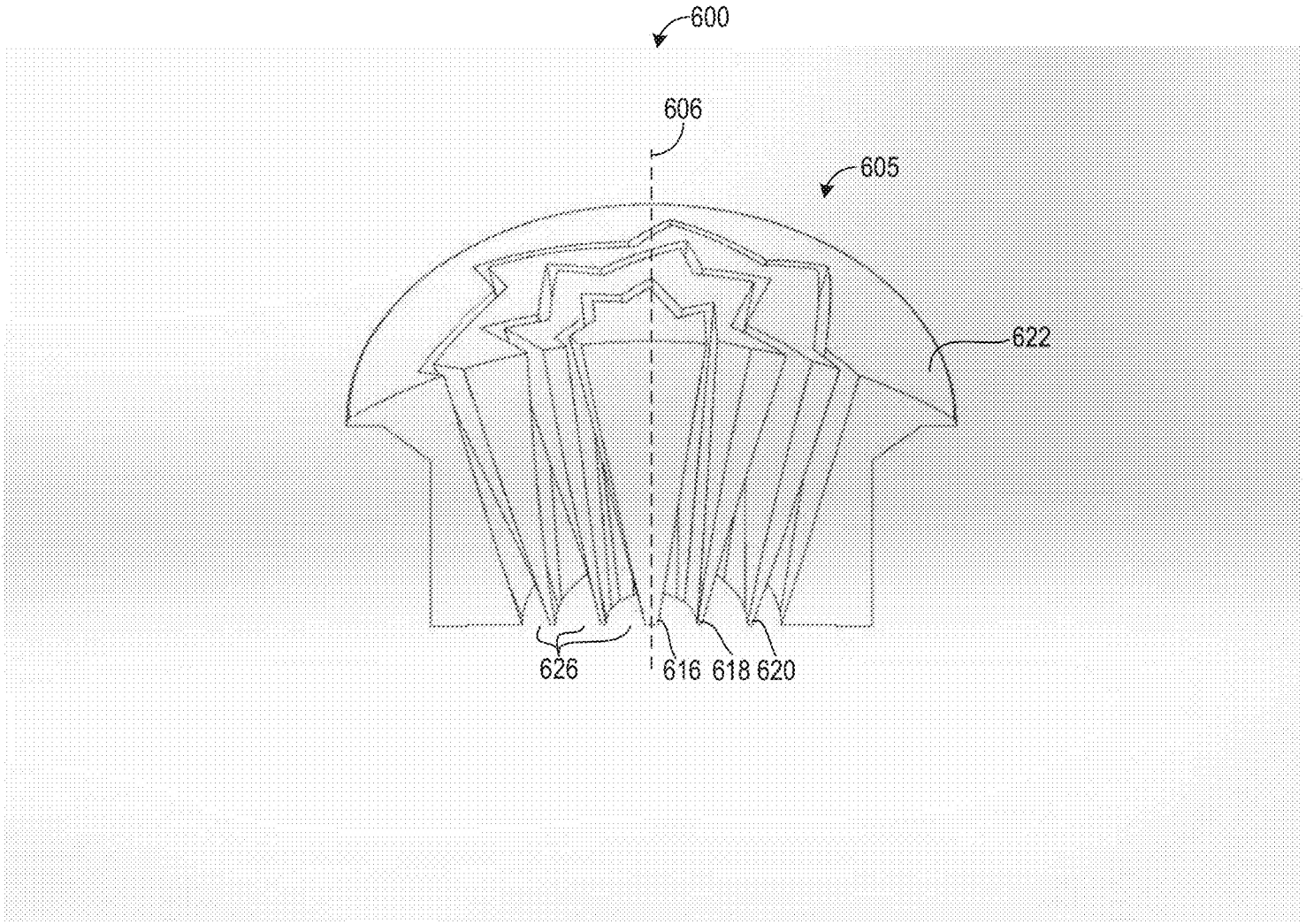

FIGS. 6A-B show various views of a phasing plug 600 in accordance with one or more embodiments of the present disclosure. As seen in the top-front perspective view shown in FIG. 6A, phasing plug 600 includes a top 602 that is generally shaped to match the shape of a diaphragm proximate which it is to be placed; in this example the top is generally convex and approximately hemispherical, having a front surface 603 contoured to a generally concave diaphragm lacking a dome or dust cap such as diaphragm 112 of FIG. 1. The degree to which top 602 is convexly curved may be modified to match its proximate diaphragm, however.

Phasing plug 600 includes four solid portions 605 that are positioned with respect to a central axis 606 extending from an inlet side 608 to an outlet side 610 of the phasing plug and along its center. Collectively, portions 605 form front surface 603, extending therefrom and forming a bottom surface 612. Proceeding outward from a radial axis 614 extending from central axis 606, portions 605 comprise an innermost portion 616, a second innermost portion 618, a second outermost portion 620, and an outermost portion 622, which collectively decrease in height with respect to central axis 606 in a smooth, gradual manner. With the exception of innermost portion 616, portions 605 are partially annular. In this example, portions 605 are approximately convex across the entire diameter of phasing plug 600 along radial axis 614 (or for any other radial axis perpendicular to and intersecting central axis 606). Portions 616, 618, 620, and 622 may be held in place by one or more structures (not shown)—e.g., mechanical bridges extending at least partially radially across the portions.

Adjacent pairs of portions 605 are separated by apertures or slots 626 that provide hollow portions through which acoustic waves may travel and further form front surface 603. Like portions 605, apertures 626 span the vertical length of phasing plug 600 (e.g., as measured along central axis 606) from front surface 603 and inlet side 608 to bottom surface 612 and outlet side 610. The numbers of portions and apertures shown are provided as non-limiting examples, however, and are not intended to be limiting in any way.

As shown, the geodesic lengths spanned by each portion 605—e.g., as measured along a geodesic 624, as well as the radial length spanned by each portion, varies as front surface 603 is traversed (e.g., circumferentially). Moreover, each aperture 626 exhibits a generally meandering, flexuous, and/or anfractuous pattern that does not regularly repeat circumferentially along front surface 603, instead varying irregularly as the front surface is traversed circumferentially in contrast to phasing plugs 200, 300, 400, and 500. The aperture patterns of phasing plug 600 generally vary in an irregular sawtooth manner, having sharp, angular bends irregularly distributed throughout. In this example, the patterns include eight peaks (e.g., peak 628) and eight troughs (e.g., trough 630) separated by intervening curved segments (e.g., segment 632). Other numbers of peaks 628 and troughs 630 are possible without departing from the scope of this disclosure, however. As a consequence of the irregular aperture pattern, segments 632 have irregular lengths as front surface 603 is traversed circumferentially. In some embodiments, one or more segments 632 may exhibit the same length, while in other embodiments each segment may exhibit a unique length. As another consequence of the irregular aperture pattern, adjacent peaks 628 and troughs 630 are not aligned along respective geodesics (e.g., geodesic 624).

In some embodiments, each segment 632 may exhibit two regions of differing curvature separated approximately at its midpoint by an inflection point (e.g., inflection point 633). In some embodiments, the number of peaks 628 and/or troughs 630 may differ for different apertures 626. Due to their intervening placement, apertures 626 define generally meandering, flexuous, and/or anfractuous irregular perimeters for each of portions 605; with the exception of outermost portion 622, which has a circular outer perimeter, and innermost portion 616 which lacks an inner perimeter, the remaining portions have inner and outer perimeters that exhibit such a pattern.

The geodesic and/or radial distribution of portions 605 and apertures 626, lengths of segments 632, positioning of adjacent peaks 628 and/or troughs 630, and the general irregularity of phasing plug 600 may be at least partially randomized. For example, phasing plug 600 may represent partially randomized modification of the approximately sawtooth aperture pattern of phasing plug 200 shown in FIG. 2.

FIG. 6B shows a top-front perspective view of a cross-section of phasing plug 600 taken along line E-E in FIG. 6A. The variation in the cross-sectional area of portions 605 along central axis 606 is particularly illustrated. As shown, the cross-sectional area of portions 605 generally decreases in a conical manner as central axis 606 is traversed downwardly. The respective rates of decrease in cross-sectional area for innermost portion 616, second innermost portion 618, and second outermost portion 620 may be approximately constant throughout the height of phasing plug 600. Relative to the cross-sectional areas of its neighboring portions 605, the cross-sectional area of innermost portion 616 decreases at a faster rate. Outermost portion 622 displays a somewhat constant rate of change in its cross-sectional area, however, notwithstanding a small region of relatively irregular cross-sectional variation proximate the bottom edge of top 602. The path-lengths of apertures 626 (a path-length for a given aperture being the distance along which acoustic waves travel in that aperture, for example) may be substantially equal (e.g., within several millimeters).

As similarly described above with respect to phasing plug 500 of FIG. 5, phasing plug 600 may include other components such as a midsection coupled to top 502 and a bottom coupled to the midsection, the top, midsection, and bottom collectively housing respective subsets of portions 605. Further, portions 605 may define bottom surface 612 which includes solid annular portions (with the exception of innermost portion 616) separated by hollow annular apertures 626. As described in further detail below, portions 605 and apertures 626 may become annular (with the exception of innermost portion 616) and regularly spaced along bottom surface 612, while in other embodiments, the irregular patterns exhibited by the portions and apertures at inlet side 608 may continue along central axis 606 and extend to the bottom surface.

Figure 7:
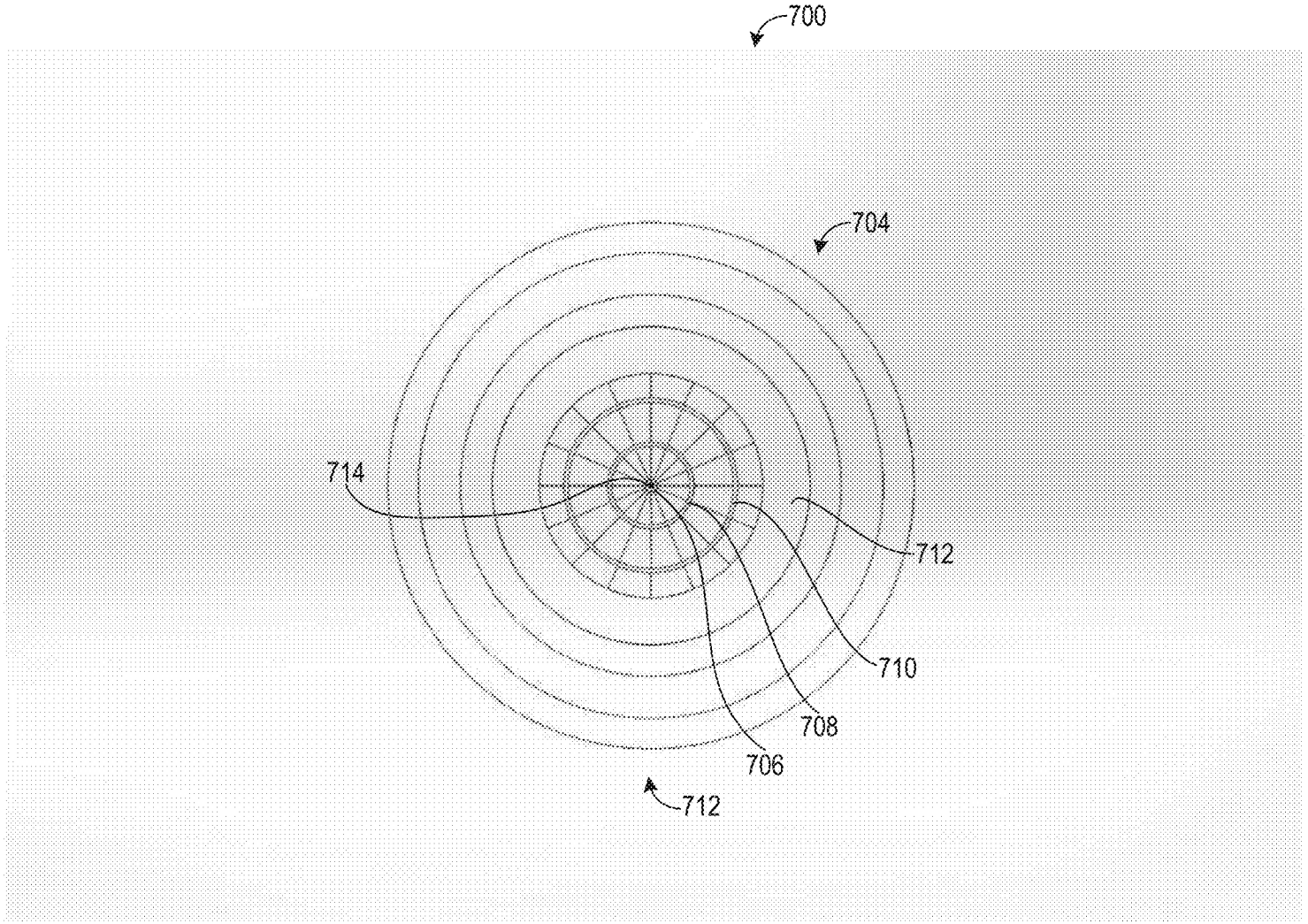
FIGS. 7-9 show bottom views of various phasing plugs in accordance with one or more embodiments of the present disclosure.
Figure 8:
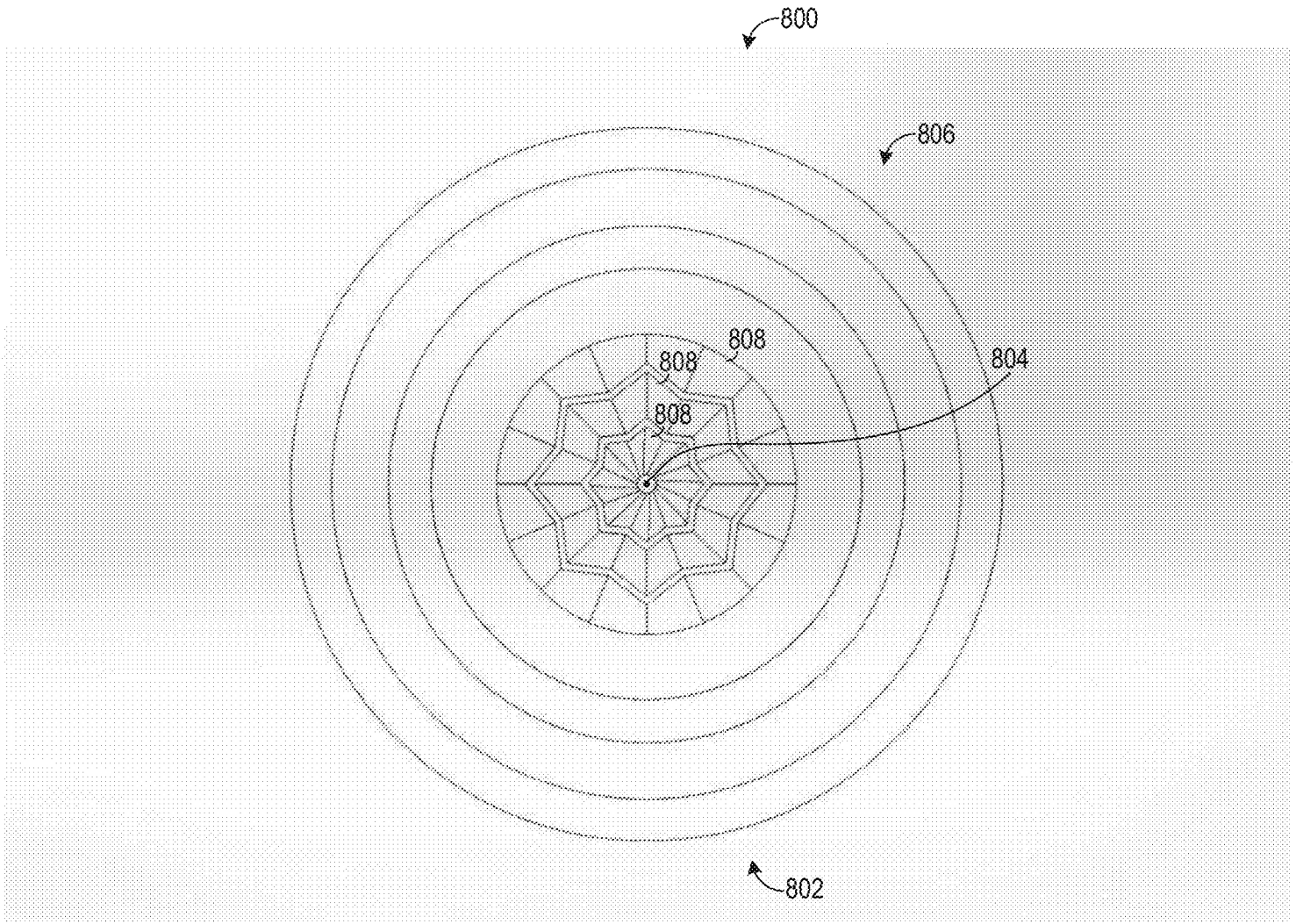
Figure 9:
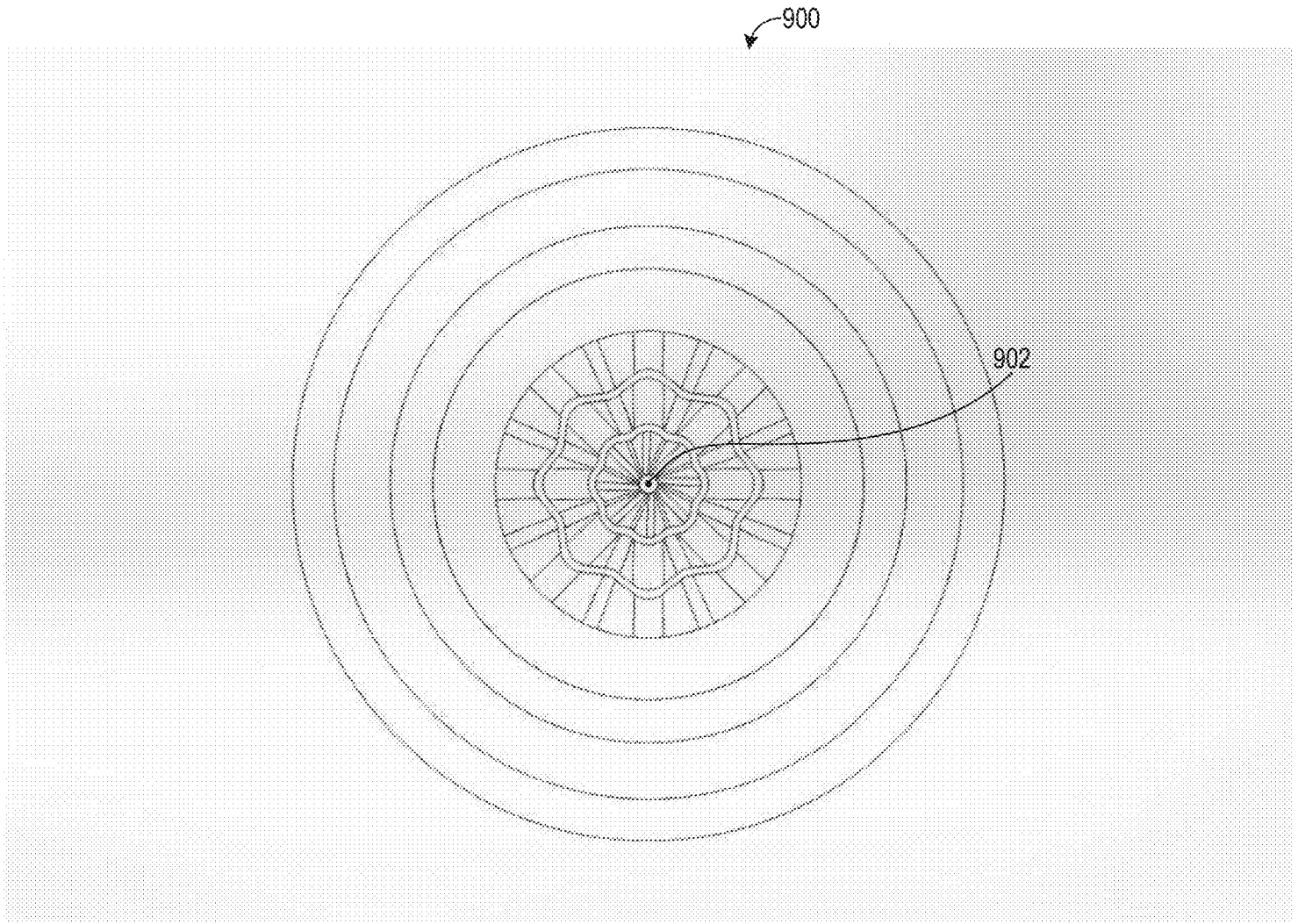

FIGS. 7-9 show bottom views of various phasing plugs in accordance with one or more embodiments of the present disclosure. In particular, FIGS. 7-9 show how the aperture/portion geometry of a phasing plug may be varied along its bottom surface, and how such geometry at the bottom surface may transition from a different geometry at an inlet side of the phasing plug or continue the geometry at the inlet side.

FIG. 7 shows a bottom view of a phasing plug 700 having a generally annular geometry at a bottom surface 702. Specifically, phasing plug 700 includes four portions 704 (innermost portion 706, second innermost portion 708, second outermost portion 710, and outermost portion 712). With the exception of innermost portion 706 which exhibits a circular geometry, portions 704 exhibit annular geometries along bottom surface 702. The annular and circular geometries of portions 704 along bottom surface 702 may differ from their geometries exhibited at an inlet side opposite the bottom surface, however. As such, the geometries of portions 704 may transition from a first geometry to a second geometry as phasing plug 700 is traversed along a central axis 714. For example, phasing plug 700 may assume at its inlet side opposite bottom surface 702 a portion/aperture pattern corresponding to the approximately sawtooth portion/aperture pattern of phasing plug 200 shown in FIG. 2A. In this example, this portion/aperture pattern of phasing plug 700 may smoothly transition in the manner described above and depicted in FIG. 2D, until reaching bottom surface 702 where portions 704, save for innermost portion 706, assume the annular geometries shown in FIG. 7. Similarly, smooth transition in this manner may also apply to other portion/aperture patterns such as the approximately sinusoidal pattern of phasing plug 400 or the irregular pattern of phasing plug 600, for example.

FIG. 8 shows a bottom view of a phasing plug 800 having a generally sawtooth geometry at a bottom surface 802. In contrast to phasing plug 700, phasing plug 800 illustrates how a portion/aperture pattern employed at an inlet side may be continued throughout the phasing plug such that the portion/aperture pattern is at least partially employed at bottom surface 702 as well. In this example, phasing plug 700 exhibits the approximately sawtooth portion/aperture pattern exhibited by phasing plug 200. Unlike phasing plug 200, however, this sawtooth portion/aperture pattern is continued throughout phasing plug 800 as the phasing plug is traversed along a central axis 804 until reaching bottom surface 802 where portions 806 and apertures 808 continue to exhibit the portion/aperture pattern. In some embodiments, the relative positioning of portions and apertures 806 and 808 at the inlet side of phasing plug 800 may be maintained at bottom surface 802—for example, the ratio of two geodesic lengths of respective apertures at the inlet side may be approximately the same (e.g., within 5%) as their corresponding ratio of radial lengths along bottom surface 802. Geodesic alignment of adjacent peaks and troughs at the inlet side may be maintained via radial alignment of adjacent peaks and troughs at bottom surface 802 as well, for example.

FIG. 9 shows a bottom view of a phasing plug 900, illustrating how the maintenance of a portion/aperture pattern throughout a phasing plug described above may apply to a generally sinusoidal portion/aperture pattern. The sinusoidal portion/aperture pattern may be the pattern of phasing plug 400, for example, and may be maintained throughout phasing plug 900 as it is traversed along a central axis 902 in the manners described above. Maintenance of a portion/aperture pattern may apply to yet other patterns, such as the irregular pattern of phasing plug 600, for example.

As shown and described, phasing plugs 200, 300, 400, 500, 600, 700, 800, and 900 shown respectively in FIGS. 2A-E, 3A-G, 4A-F, 5A-C, 6A-B, 7, 8, and 9 may be utilized in a loudspeaker (e.g., compression driver) to mitigate issues inherent to other phasing plug designs. For example, undesired resonance and/or cancellation in a compression chamber (e.g., compression chamber 122), and other effects resulting therefrom (e.g., uneven frequency response, high-frequency attenuation, peaking, etc.) may be reduced via the phasing plug configurations disclosed herein. A loudspeaker incorporating such configurations may exhibit an improved frequency response particularly in a midrange frequency band and an extended response in an upper frequency band.

Phasing plugs 200, 300, 400, 500, 600, 700, 800, and 900 may be formed in various suitable manners, including those in which are formed as a unity, contiguous element and those in which two or more portions of the phasing plugs are separately formed and subsequently joined together. Moreover, the phasing plugs may be comprised of various suitable materials including numerous plastics such as Bakelite.

Various modifications may be made to the phasing plug configurations disclosed herein. For example, numerous properties of the phasing plugs may be modified, including but not limited to the dimensions (e.g., width, height, length), relative placement, radial and/or geodesic distribution, and curvature of the phasing plugs and their elements (e.g., portions, apertures, etc.). Variations of the aperture and portion patterns disclosed herein may be modified without departing from the scope of the disclosure, particular aspects including but not limited to the degree to which an aperture and/or portion pattern resembles a sawtooth or sinusoidal pattern, as well as the number of peaks and/or troughs in a given pattern and the number of portions and apertures comprising a phasing plug. The phasing plugs and their elements may be further scaled according to a loudspeaker to which they are to be acoustically coupled, and the number of portions and apertures may also be modified. It will also be appreciated that the geometries and cross-sectional areas of the midsections, bottoms, frames, and mounts are provided as examples and are not intended to be limiting.

The geometry of phasing plugs 200, 300, 400, 500, 600, 700, 800, and 900 may be tailored to virtually any diaphragm to which the phasing plugs may be acoustically coupled. For example, the geometry of phasing plugs 200, 300, 400, 500, 600, 700, 800, and 900 may be tailored to diaphragms having convex, concave, parabolic, spherical (e.g., hemispherical), conical, flat, polygonal, and other geometries including those that utilize portions and/or combinations of the aforementioned geometries—e.g., the phasing plugs may be contoured to a diaphragm having a geometry corresponding to that of a truncated frustum of a cone (e.g., a partially conical geometry). Moreover, phasing plugs 200, 300, 400, 500, 600, 700, 800, and 900 may be tailored to diaphragms that utilize a dome and to virtually any geometry exhibited by the dome, including but not limited to convex, concave, parabolic, spherical (e.g., hemispherical), conical, flat, polygonal, and other geometries including those that utilize portions and/or combinations of the aforementioned geometries.

The description of embodiments has been presented for purposes of illustration and description. Suitable modifications and variations to the embodiments may be performed in light of the above description or may be acquired from practicing the methods. For example, unless otherwise noted, one or more of the described methods may be performed by a suitable device and/or combination of devices. The described methods and associated actions may also be performed in various orders in addition to the order described in this application, in parallel, and/or simultaneously. The described systems are exemplary in nature, and may include additional elements and/or omit elements. The subject matter of the present disclosure includes all novel and non-obvious combinations and sub-combinations of the various systems and configurations, and other features, functions, and/or properties disclosed.

As used in this application, an element or step recited in the singular and proceeded with the word "a" or "an" should be understood as not excluding plural of said elements or steps, unless such exclusion is stated. Furthermore, references to "one embodiment" or "one example" of the present disclosure are not intended to be interpreted as excluding the existence of additional embodiments that also incorporate the recited features. The terms "first," "second," and "third," etc. are used merely as labels, and are not intended to impose numerical requirements or a particular positional order on their objects. The following claims particularly point out subject matter from the above disclosure that is regarded as novel and non-obvious.

The invention claimed is:

1. A phasing plug for an electroacoustic transducer, comprising:

an inlet side;

an outlet side;

a front surface on an outer surface of the inlet side; and a plurality of portions having an anfractuous perimeter along the front surface and forming apertures therebetween, the plurality of portions and apertures arranged along a central axis and extending from the inlet side to the outlet side.

2. The phasing plug of claim 1, wherein the anfractuous perimeter is an approximately sawtooth pattern.

3. The phasing plug of claim 1, wherein the anfractuous perimeter is an approximately sinusoidal pattern.

4. The phasing plug of claim 1, wherein the plurality of portions comprises four portions and forms three apertures therebetween; and wherein the anfractuous perimeter has a varying radius on the front surface, as measured from the central axis.

5. The phasing plug of claim 1, wherein at least one of the plurality of portions includes a plurality of sections regularly spaced around a meandering boundary, the meandering boundary separating two different regions of curvature.

6. The phasing plug of claim 1, wherein the front surface is formed by the plurality of portions and the apertures, and where the anfractuous perimeter is located at a radial distance from the central axis, the radial distance varying as the anfractuous perimeter is traversed about the central axis along the front surface.

7. The phasing plug of claim 1, wherein the inlet side of the phasing plug faces a diaphragm of a driver, and wherein the anfractuous perimeter is at least partially irregular.

8. The phasing plug of claim 1, wherein one or more of the plurality of portions have cross-sectional areas that decrease approximately conically below respective arcs as the central axis is traversed downwardly; and wherein each portion of the plurality of portions has at least one anfractuous perimeter.

9. The phasing plug of claim 1, wherein the apertures have cross-sectional areas that increase as the central axis is traversed downwardly, and wherein the arrangement of the plurality of portions is at least partially randomized.

10. The phasing plug of claim 1, wherein one or more of the plurality of portions are annular at a bottom surface at the outlet side;

wherein the anfractuous perimeter is approximately a sawtooth pattern;

wherein the plurality of portions includes eight peaks and eight troughs separated by segments having irregular lengths;

wherein the irregular lengths are partially randomized; and wherein the peaks and troughs of adjacent portions are not aligned along geodesics.

11. The phasing plug of claim 1, wherein a geodesic length of the apertures is greater between adjacent peaks than at adjacent troughs at the front surface of the phasing plug, and wherein the anfractuous perimeter forms a complete perimeter with the central axis extended through an interior of the perimeter with the complete perimeter surrounding the central axis and being on the front surface at which a horn is coupled.

12. The phasing plug of claim 1, wherein adjacent peaks and adjacent troughs are aligned along respective geodesics along the front surface of the phasing plug.

13. The phasing plug of claim 1, wherein the plurality of portions and the apertures are symmetric across a diameter of the phasing plug with respect to a radial axis intersecting the central axis of the phasing plug.

14. The phasing plug of claim 1, wherein the apertures are evenly distributed across the front surface of the phasing plug with respect to a geodesic extending from the central axis of the phasing plug to an outer perimeter of a top of the phasing plug.

15. An electroacoustic transducer, comprising:

a waveguide;

a driver having a diaphragm; and a phasing plug positioned intermediate the waveguide and the diaphragm, the phasing plug comprising:

an inlet side facing the diaphragm and having a surface contoured to the diaphragm;

an outlet side facing the waveguide;

a central axis passing through each of the inlet and outlet sides, located such that the phasing plug is radially symmetric about the central axis; and a plurality of portions having a flexuous perimeter in a direction radial to the central axis and forming slots therebetween, the plurality of portions and slots arranged concentrically along the central axis and extending from the inlet side to the outlet side, the plurality of portions being substantially flush along a virtual plane perpendicular to the central axis at the outlet side, wherein a distance from the central axis to the flexuous perimeter varies as the flexuous perimeter is traversed about the central axis.

16. The electroacoustic transducer of claim 15, wherein the flexuous perimeter is one of an approximately syncline pattern and an approximately sinusoidal pattern; and wherein the flexuous perimeter is located on the surface contoured to the diaphragm.

17. The electroacoustic transducer of claim 15, wherein the phasing plug further comprises a top having a front surface formed by the plurality of portions and apertures, the plurality of portions and the apertures being evenly distributed along the front surface with respect to a geodesic extending from the central axis of the phasing plug to an outer perimeter of the phasing plug, wherein the phasing plug further comprises a first annular region and a second annular region, the second annular region having a different curvature than the first annular region, and wherein the flexuous perimeter lies in a plane perpendicular to the central axis.

18. A horn driver, comprising:

a horn;

a driver having a diaphragm; and a phasing plug interposed between the horn and the diaphragm, the phasing plug comprising:

an inlet side facing the diaphragm and having a surface contoured to the diaphragm;

an outlet side facing a waveguide;

a central axis passing through the inlet side and the outlet side and passing symmetrically through the diaphragm; and a plurality of portions having a meandering perimeter on the surface and forming slots therebetween, the plurality of portions and slots arranged concentrically along the central axis and extending from the inlet side to the outlet side, the plurality of portions being substantially flush along a virtual plane perpendicular to the central axis at the outlet side, wherein the meandering perimeter comprises a varying radial distance from the central axis on the surface as the meandering perimeter is traversed about the central axis, and wherein the meandering perimeter is one of an approximately syncline pattern and an approximately sinusoidal pattern.

19. The horn driver of claim 18, wherein the meandering perimeter is the approximately syncline pattern;

wherein each of the slots includes a plurality of peaks and troughs, the peaks and troughs separated by intervening segments having irregular lengths; and wherein the irregular lengths of the intervening segments are at least partially randomized.

20. The horn driver of claim 18, wherein the meandering perimeter is the approximately sinusoidal pattern; and wherein each of the slots includes eight peaks and eight troughs, the peaks and troughs separated by intervening segments having irregular lengths.

* * * * *